US010822792B2

(12) United States Patent
Park

(10) Patent No.: US 10,822,792 B2
(45) Date of Patent: Nov. 3, 2020

(54) WALL STRUCTURE USING BLOCKS AND FRAMES WITH WEDGE-TYPE COUPLING PART FORMED THEREIN AND METHOD FOR CONSTRUCTING WALL USING SAME

(71) Applicant: Jea Hong Park, Seoul (KR)

(72) Inventor: Jea Hong Park, Seoul (KR)

( * ) Notice: Subject to any disclaimer, the term of this patent is extended or adjusted under 35 U.S.C. 154(b) by 0 days.

(21) Appl. No.: 16/650,592

(22) PCT Filed: Nov. 27, 2018

(86) PCT No.: PCT/KR2018/014665
§ 371 (c)(1),
(2) Date: Mar. 25, 2020

(87) PCT Pub. No.: WO2019/132264
PCT Pub. Date: Jul. 4, 2019

(65) Prior Publication Data

US 2020/0232210 A1 Jul. 23, 2020

(30) Foreign Application Priority Data

Dec. 29, 2017 (KR) ..... 10-2017-0184760

(51) Int. Cl.
*E04B 2/08* (2006.01)
*E04B 2/18* (2006.01)
(Continued)

(52) U.S. Cl.
CPC ..... *E04B 2/08* (2013.01); *E04B 2/18* (2013.01); *E04B 2002/0206* (2013.01);
(Continued)

(58) Field of Classification Search
CPC ..... E04B 2/08; E04B 2/18; E04B 2002/0206; E04B 2002/0228; E04B 2002/0267; E04C 1/395
See application file for complete search history.

(56) References Cited

U.S. PATENT DOCUMENTS 2,291,712 A * 8/1942 Hatton ..... E04B 2/22 52/272
2,732,706 A * 1/1956 Friedman ..... E04B 2/08 52/586.1
(Continued)

FOREIGN PATENT DOCUMENTS

JP 2005-171648 A 6/2005
JP 2010-196364 A 9/2010
(Continued)

*Primary Examiner* — James M Ference
(74) *Attorney, Agent, or Firm* — Novick, Kim & Lee, PLLC; Jae Youn Kim

(57) ABSTRACT

A block for decorating an outer wall or an inner wall in construction work and a construction method for bricklaying work, and more particularly, to a wall structure using blocks and frames each having a wedge-shaped coupling part formed therein and a method of constructing a wall using the same, wherein frames, which are integrally formed with beams, slabs, and pillars of a building to serve as a frame structure, are fixed and mounted, an isosceles triangular wedge-shaped concave groove or protrusion is formed on inner surfaces of the mounted frames, and blocks and intermediate blocks, in which an isosceles triangular wedge-shaped concave groove or protrusion is formed, are laid on the frames, thereby solving a disadvantage of bricklaying work in that it is vulnerable to horizontal vibration and improving seismic performance.

20 Claims, 26 Drawing Sheets

(51) Int. Cl.
*E04B 2/02* (2006.01)
*E04C 1/39* (2006.01)

(52) U.S. Cl.
CPC ..... *E04B 2002/0228* (2013.01); *E04B 2002/0267* (2013.01); *E04C 1/395* (2013.01)

(56) References Cited

U.S. PATENT DOCUMENTS 2,902,733 A * 9/1959 Justus ..... E04B 2/702 52/284
2,932,745 A * 4/1960 Gotting ..... G21C 11/028 250/517.1
2,970,218 A * 1/1961 Shaw ..... G21C 11/028 250/517.1
3,355,849 A * 12/1967 Hancock ..... E04B 2/22 52/396.08
3,394,517 A * 7/1968 Caterina ..... F27D 1/04 52/436
3,440,784 A * 4/1969 Onjukka ..... E04B 2/702 52/233
3,529,389 A * 9/1970 Wilkins ..... E04B 1/6125 174/497
3,534,518 A * 10/1970 Zagray ..... F27B 9/26 52/258
3,614,446 A * 10/1971 Leuthold ..... E04B 2/08 250/517.1
3,956,862 A * 5/1976 Alexandre, Jr. ..... E04B 2/22 52/286
4,035,975 A * 7/1977 Gergely ..... E04B 2/18 52/284
4,299,069 A * 11/1981 Neumann ..... E04C 2/30 52/309.4
4,314,431 A * 2/1982 Rabassa ..... E04B 2/46 52/259
4,429,506 A * 2/1984 Henderson ..... E04B 2/08 52/274
4,614,071 A * 9/1986 Sams ..... E04C 1/41 52/309.12
4,956,958 A * 9/1990 Caroti ..... E04B 2/18 52/605
5,226,276 A * 7/1993 Cahill ..... E04C 2/40 52/592.6
6,253,518 B1 * 7/2001 Azar ..... E04B 2/06 52/589.1
D447,819 S * 9/2001 Bilka ..... E04B 2/06 D25/113
D457,656 S * 5/2002 Bilka ..... E04B 2/06 D25/113
6,418,680 B1 * 7/2002 Calkins ..... E04B 1/10 52/233
6,539,682 B1 * 4/2003 Ryder ..... E04B 2/48 52/437
6,606,835 B1 * 8/2003 Bilka ..... E04B 2/06 52/311.1
6,665,994 B1 * 12/2003 Ruggeri ..... E04B 2/14 52/592.6
7,610,730 B2 * 11/2009 O'Connor ..... E04B 2/16 52/442
7,946,090 B1 * 5/2011 Walters ..... E04C 1/40 52/309.12
8,281,530 B2 * 10/2012 Chaussee ..... E04F 13/0803 52/290
8,701,364 B2 * 4/2014 Wrightman ..... E04C 3/127 52/233
8,800,230 B2 * 8/2014 O'Connor ..... E04B 2/16 52/442
9,091,059 B2 * 7/2015 Wrightman ..... E04B 2/702
9,183,957 B2 * 11/2015 Farrell ..... G21F 3/00
9,404,234 B2 * 8/2016 Jain ..... E02D 27/32
9,404,255 B1 * 8/2016 Castro ..... E04B 2/54
2002/0021042 A1 * 2/2002 Damron ..... E21F 1/14 299/12
2004/0118056 A1 * 6/2004 Peters ..... A63H 33/084 52/79.1
2004/0163358 A1 * 8/2004 Clarke ..... E04C 3/12 52/782.1
2006/0207206 A1 * 9/2006 Everett ..... E04B 2/06 52/604
2006/0242914 A1 * 11/2006 Stephansky ..... F27D 1/0006 52/27
2006/0260256 A1 * 11/2006 Everett ..... E04B 2/16 52/605
2007/0113510 A1 * 5/2007 Evereff ..... E04B 2/06 52/592.6
2011/0203197 A1 * 8/2011 Najafi ..... E04B 2/06 52/173.1

FOREIGN PATENT DOCUMENTS

JP 5519163 B2 6/2014
KR 10-0646609 B1 11/2006
KR 10-0649984 B1 11/2006
KR 10-2010-0081651 A 7/2010
KR 10-1071364 B1 10/2011

* cited by examiner section A - A' section B - B' section C - C' section D - D'

WALL STRUCTURE USING BLOCKS AND FRAMES WITH WEDGE-TYPE COUPLING PART FORMED THEREIN AND METHOD FOR CONSTRUCTING WALL USING SAME

TECHNICAL FIELD

The present invention relates to a block for decorating an outer wall or an inner wall in construction work and a construction method for bricklaying work, and more particularly, to a wall structure using blocks and frames each having a wedge-shaped coupling part formed therein and a method of constructing a wall using the same, wherein frames which serve as a frame structure are installed on beams, slabs, and pillars and blocks are stacked within the installed frames, thereby solving a disadvantage of bricklaying work in that it is vulnerable to impact and earthquakes because a frame structure is not formed in a construction process in which blocks are adhered and stacked with mortar, an isosceles triangular wedge-shaped protrusion or wedge-shaped concave groove is formed throughout upper, lower, left, and right surfaces of the blocks to allow adjacent blocks to be firmly coupled and an isosceles triangular wedge-shaped protrusion or wedge-shaped concave groove is formed throughout inner surfaces of the frames, which are in contact with the blocks, to firmly fix the blocks stacked within the frames, thereby preventing the blocks from being detached due to external impact or earthquakes, and inclined surfaces of the wedge-shaped protrusions and wedge-shaped concave grooves allow the stacked blocks to be restored to their original positions even when the blocks are misaligned, thereby significantly improving seismic performance.

BACKGROUND ART

Generally, when forming a wall at an outer wall or an inner wall of a building, bricklaying work is performed in which bricks or blocks formed of concrete or the like are stacked to form a wall and mortar is applied between the stacked blocks so that the blocks are adhered to each other. The bricklaying work is a technique that is widely used due to its advantages of facilitating construction, excellent moisture resistance and durability, and low construction cost.

In the above-described bricklaying structure in which the blocks are adhered using mortar, due to the structure of stacking the blocks, support is not easily lost by vibration or impact acting in a vertical direction. However, the bricklaying structure is vulnerable to vibration or impact acting in a horizontal direction, and even fine vibration that occurs repeatedly may cause the mortar, with which the blocks are adhered and fixed, to be separated from the blocks, thus decreasing a coupling force between the blocks. Accordingly, there is a problem in that cracks are formed in the wall or the wall collapses as the stacked blocks are detached.

Particularly, due to the characteristic of the bricklaying structure in that it is vulnerable to the vibration or impact acting in the horizontal direction, when an earthquake occurs, the wall collapses, increasing the likelihood of a major accident. In recent years, with a gradual increase in the magnitude and number of earthquakes occurring in South Korea, damage cases have rapidly increased with regards to buildings built using a bricklaying construction method, in which blocks are adhered with mortar, in earthquake-affected areas, and the need for seismic design in bricklaying work has come to the fore.

To improve seismic performance of the bricklaying structure which lacks resistance to the vibration or impact acting in the horizontal direction as described above, a frame structure is required for fixing the blocks so that the laid blocks are not detached from the wall. Korean Patent Registration No. 10-1071364 proposes an assembly structure of construction blocks, in which a coupling protrusion is formed at an upper portion and one side surface of each block and a coupling groove is formed at a lower portion and the other side surface of each block such that the blocks are assembled by fitting the coupling grooves and the coupling protrusions to each other, a reinforcing member and a frame are sequentially mounted on upper, lower, left, and right edges of each laid block, and then the frames and the blocks are fixed using a fixing member.

However, the assembly structure according to the above registered patent is directed to shortening a bricklaying work period by assembling blocks and frames to form walls and then installing the formed walls on a building. As in the conventional bricklaying work, there are problems in that, because frames for fixing the blocks are not configured to move integrally with beams, slabs, and pillars that support a major load acting on a building, a wall may collapse as the frames are separated from the building when an earthquake occurs, and, because, due to the shape characteristics of the coupling protrusions and the coupling grooves formed at the blocks, stress is prone to concentrate on inner side corners of connecting portions formed at the coupling protrusions and the coupling grooves formed at the blocks when an earthquake occurs or external impact acts on the building, a wall may collapse as the coupling protrusions or the coupling grooves are damaged due to the stress concentrated thereon.

DISCLOSURE

Technical Problem

The present invention is directed to providing improvement to seismic performance in bricklaying work by fixing and installing frames on beams, slabs, and pillars that support a major load of a building so that the frames move integrally with the beams, slabs, and pillars when an earthquake occurs or external impact acts on the building and fitting and fixing blocks to the frames integrally fixed with the building so that a frame structure is formed in bricklaying work for constructing a wall.

The present invention is directed to providing a coupling structure between blocks that is capable of preventing stacked blocks from being detached from each other and, even when the blocks are misaligned due to an earthquake or external impact acting thereon, allowing the blocks to be restored to their original positions by shape characteristics of wedge-shaped protrusions and wedge-shaped concave grooves of coupling surfaces.

The present invention is directed to providing a coupling structure between blocks that is capable of preventing blocks and frames, which are fixed and installed on a building, from being detached from each other and, even when the blocks and the frames are misaligned due to an earthquake or external impact acting thereon, allowing the blocks and the frames to be restored to their original positions by shape characteristics of wedge-shaped protrusions and wedge-shaped concave grooves of coupling surfaces.

The present invention is directed to providing improvement to watertightness, sound insulation, and windproofness of a wall by firmly coupling frames and blocks through wedge-shaped protrusions and wedge-shaped concave grooves formed on the blocks and frames.

The present invention is directed to providing further improvement to watertightness, sound simulation, and windproofness of a wall by forming a dense structure in a constructed wall by applying an adhesive between coupling surfaces of blocks in a wall for which watertightness, sound insulation, and windproofness are important.

Technical Solution

An embodiment of the present invention provides a wall structure using blocks and frames each having a wedge-shaped coupling part formed therein, the wall structure including: an upper frame mounted on a surface of a beam, the upper frame having an isosceles triangular wedge-shaped concave groove formed throughout a lower surface, wherein a corner of the wedge-shaped concave groove is parallel to a longitudinal direction of the beam; a lower frame mounted on a surface of a slab, the lower frame having an isosceles triangular wedge-shaped protrusion formed throughout an upper surface, wherein a corner of the wedge-shaped protrusion is parallel to a longitudinal direction of the slab; vertical frames mounted on outer side or inner side surfaces of pillars so as to be connected to ends of the upper frame and the lower frame, the vertical frames each having an isosceles triangular wedge-shaped protrusion formed throughout an inner side surface, wherein a corner of the wedge-shaped protrusion is parallel to a height direction of the pillar; blocks laid by being fitted between the upper frame, the lower frame, and the vertical frames, the blocks each having an isosceles triangular wedge-shaped upper protrusion formed throughout an upper surface, an isosceles triangular wedge-shaped lower concave groove formed throughout a lower surface, and an isosceles triangular wedge-shaped side protrusion and an isosceles triangular wedge-shaped side concave groove formed throughout both side surfaces, wherein, by the wedge-shaped upper protrusion and the wedge-shaped lower concave groove being fitted to each other, and the wedge-shaped side protrusion and the wedge-shaped side concave groove being fitted to each other, the blocks are laid in a zigzag manner so that longitudinal side corners of the blocks are positioned on a central portion of the upper surface or the lower surface of the block stacked vertically adjacent thereto; intermediate blocks fitted between the blocks to change a direction in which the blocks are laid, so that the wedge-shaped side concave grooves of the laid blocks are coupled to the wedge-shaped protrusions of the vertical frames, the intermediate blocks each having an isosceles triangular wedge-shaped upper protrusion formed throughout an upper surface, an isosceles triangular wedge-shaped lower concave groove formed throughout a lower surface, and an isosceles triangular wedge-shaped side concave groove formed throughout both side surfaces; and a finish frame formed of two frame bodies, which have a rhombic cross-section and are symmetrical to each other, and a frame body fastener configured to pass through and fix the two frame bodies, wherein the two frame bodies are coupled by being fitted between the blocks laid on the uppermost end portion and the upper frame in directions toward an outer side and an inner side of a wall surface formed by the laid blocks, upper surfaces of the two coupled frame bodies are engaged to come in close contact with the wedge-shaped concave groove of the upper frame, and lower surfaces of the frame bodies are engaged to come in close contact with the wedge-shaped upper protrusions of the blocks laid on the uppermost end portion.

According to an embodiment of the present invention, one or more horizontal reinforcing frames may be mounted between the upper frame and the lower frame so as to be parallel to the upper frame and the lower frame, the one or more horizontal reinforcing frames each having an isosceles triangular wedge-shaped protrusion formed throughout an upper surface and an isosceles triangular wedge-shaped concave groove formed throughout a lower surface, wherein corners of the wedge-shaped protrusion and the wedge-shaped concave groove may be parallel to a longitudinal direction of the upper frame and the lower frame, and the finish frame may be fitted and fixed between the wedge-shaped upper protrusions of the laid blocks and the wedge-shaped concave grooves of the horizontal reinforcing frames.

According to an embodiment of the present invention, one or more vertical intermediate frames may be installed between the vertical frames at both sides, an upper end and a lower end of the vertical intermediate frame may be connected and coupled to a surface of a beam and a surface of slab, respectively, both side ends of the horizontal reinforcing frame may be fixed to side surfaces of the vertical frame and the vertical intermediate frame by a fastening material, an isosceles triangular wedge-shaped protrusion may be formed throughout both side surfaces of the vertical intermediate frame, a corner of the wedge-shaped protrusion may be parallel to a height direction of a pillar, and the wedge-shaped protrusion of the vertical intermediate frame may be engaged to come in close contact with the wedge-shaped side concave groove of the laid block.

According to an embodiment of the present invention, the isosceles triangular wedge-shaped protrusions and the isosceles triangular wedge-shaped concave grooves of the frames, the blocks, and the intermediate blocks may be configured to form an obtuse angle.

According to an embodiment of the present invention, binding surfaces of the block and the intermediate block may be finished with water-swellable water stop rubber.

According to an embodiment of the present invention, the upper frame, the lower frame, and the vertical frame may each be formed of a double structure such that the upper frame, the lower frame, and the vertical frame which are at an outer side come in close contact toward the outside of an outer side surface of a pillar and the upper frame, the lower frame, and the vertical frame which are at an inner side are spaced apart toward the inside of the outer side surface of the pillar, the vertical frame installed at the outer side may be bent in an L-shape such that a bent inner side surface of the vertical frame is mounted to come in close contact with an outer corner of a pillar at an outer boundary, and an insulator panel may be configured to be fitted in a space between the blocks which are laid by being fitted to each of the upper frames, the lower frames, and the vertical frames at the outer side and the inner side.

According to an embodiment of the present invention, the outer side or inner side frames may be formed of a double structure in which wedge-shaped concave grooves of the upper frames at the outer side or inner side of the pillar are disposed side by side in two columns so as to form a W-shaped concave groove, wedge-shaped protrusions of the lower frames at the outer side or inner side of the pillar are disposed in two columns so as to form a W-shaped protrusion, and wedge-shaped protrusions of the vertical frames at the outer side or inner side of the pillar are disposed in two columns so as to form a W-shaped protrusion.

According to an embodiment of the present invention, double blocks, each having isosceles triangular wedge-shaped upper protrusions disposed in two columns throughout an upper surface so as to form a W-shaped upper protrusion, isosceles triangular wedge-shaped lower concave grooves disposed in two columns throughout a lower surface so as to form a W-shaped lower concave groove, isosceles triangular wedge-shaped side protrusions disposed in two columns throughout one side surface so as to form a W-shaped side protrusion, and isosceles triangular wedge-shaped side concave grooves disposed in two columns throughout the other side surface so as to form a W-shaped side concave groove, may be, by the wedge-shaped upper protrusion and the wedge-shaped lower concave groove being fitted to each other, and the wedge-shaped side protrusion and the wedge-shaped side concave groove being fitted to each other, laid in a zigzag manner on the outer side frames formed of the double structure so that longitudinal side corners of the double blocks are positioned on a central portion of the upper surface or the lower surface of the double block stacked vertically adjacent thereto, and double intermediate blocks may be fitted between the double blocks to change a direction in which the double blocks are laid, so that the W-shaped side concave groove of the laid double blocks is coupled to the W-shaped protrusion of the vertical frame, the double intermediate blocks each having isosceles triangular wedge-shaped upper protrusions disposed in two columns throughout an upper surface so as to form a W-shaped upper protrusion, isosceles triangular wedge-shaped lower concave grooves disposed in two columns throughout a lower surface so as to form a W-shaped lower concave groove, and isosceles triangular wedge-shaped side concave grooves disposed in two columns throughout both side surfaces so as to form a W-shaped side concave groove.

According to an embodiment of the present invention, a window frame may be integrally formed at a central portion of the horizontal reinforcing frame, the window frame having isosceles triangular wedge-shaped protrusions formed throughout both side surfaces so as to head toward the vertical frames at both sides.

According to an embodiment of the present invention, a waterproof plywood with an adhesive layer formed thereon may be attached to a surface of the insulator panel.

An embodiment of the present invention provides a method of constructing a wall using blocks and frames each having a wedge-shaped coupling part formed therein, the method including: a step of installing frames, in which an upper frame is mounted on a surface of a beam, the upper frame having an isosceles triangular wedge-shaped concave groove formed throughout a lower surface, wherein a corner of the wedge-shaped concave groove is parallel to a longitudinal direction of a beam, a lower frame is mounted on a surface of a slab, the lower frame having an isosceles triangular wedge-shaped protrusion formed throughout an upper surface, wherein a corner of the wedge-shaped protrusion is parallel to a longitudinal direction of the slab, and vertical frames are mounted on inner side surfaces of pillars so as to be connected to ends of the upper frame and the lower frame, the vertical frames each having an isosceles triangular wedge-shaped protrusion formed throughout an inner side surface, wherein a corner of the wedge-shaped protrusion is parallel to a height direction of the pillar; a step of laying blocks and intermediate blocks, in which, when blocks are laid by being fitted between the upper frame, the lower frame, and the vertical frame, the blocks each having an isosceles triangular wedge-shaped upper protrusion formed throughout an upper surface, an isosceles triangular wedge-shaped lower concave groove formed throughout a lower surface, and an isosceles triangular wedge-shaped side protrusion and an isosceles triangular wedge-shaped side concave groove formed throughout both side surfaces, wherein, by the wedge-shaped upper protrusion and the wedge-shaped lower concave groove being fitted to each other, and the wedge-shaped side protrusion and the wedge-shaped side concave groove being fitted to each other, the blocks are laid in a zigzag manner so that longitudinal side corners of the blocks are positioned on a central portion of the upper surface or the lower surface of the block stacked vertically adjacent thereto, intermediate blocks are fitted between the blocks to change a direction in which the blocks are laid, so that the wedge-shaped side concave groove of the blocks is coupled to the wedge-shaped protrusion of the vertical frames at both sides, the intermediate blocks each having an isosceles triangular wedge-shaped upper protrusion formed throughout an upper surface, an isosceles triangular wedge-shaped lower concave groove formed throughout a lower surface, and an isosceles triangular wedge-shaped side concave groove formed throughout both side surfaces; and a step of fastening a finish frame, in which upper surfaces of frame bodies of a finish frame are engaged to come in close contact with the wedge-shaped concave groove of the upper frame, lower surfaces of the frame bodies are engaged to come in close contact with the wedge-shaped upper protrusions of the blocks laid on the uppermost end portion, and then the frame bodies are fixed using a frame body fastener, wherein the finish frame includes two frame bodies which have a rhombic cross-section and are symmetrical to each other.

According to an embodiment of the present invention, the step of installing the frames may include a step of installing horizontal reinforcing frames, in which one or more horizontal reinforcing frames are mounted between the upper frame and the lower frame so as to be parallel to the upper frame and the lower frame, the one or more horizontal reinforcing frames each having an isosceles triangular wedge-shaped protrusion formed throughout an upper surface and an isosceles triangular wedge-shaped concave groove formed throughout a lower surface, and the step of fastening the finish frame may include a step of fastening a finish frame for horizontal reinforcement, in which the finish frame is fitted and fixed between the wedge-shaped upper protrusions of the blocks, which are laid on each layer formed by the horizontal reinforcing frames in the step of laying the blocks and the intermediate blocks, and the wedge-shaped concave grooves of the horizontal reinforcing frames.

According to an embodiment of the present invention, the method may further include, after the step of installing the horizontal reinforcing frames, a step of installing vertical intermediate frames, in which one or more vertical intermediate frames, each having an isosceles triangular wedge-shaped protrusion formed throughout both side surfaces, are installed between the vertical frames at both sides, an upper end and a lower end of the one or more vertical intermediate frames are connected and coupled to a surface of a beam and a surface of slab, respectively, and both side ends of the horizontal reinforcing frame are fixed to side surfaces of the vertical frame and the vertical intermediate frame by a fastening material so as to divide a wall surface into sections, of which adjacent sections are coupled by the same vertical intermediate frame.

According to an embodiment of the present invention, the step of laying the blocks and the intermediate blocks may include a step of applying an adhesive, in which the blocks and the intermediate blocks are laid after an adhesive is applied on each interface of the blocks and the intermediate blocks.

According to an embodiment of the present invention, the step of installing the frames may include a step of installing double frames, in which the upper frame, the lower frame, and the vertical frame which are at the outer side are installed to come in close contact toward the outside of an outer side surface of a pillar and the upper frame, the lower frame, and the vertical frame which are at an inner side are spaced apart toward the inside of the outer side surface of the pillar so that double frames are formed, and the method may further include, between the step of installing the double frames and the step of laying the blocks and the intermediate blocks, an insulation construction step in which an insulator panel is attached to the double frames.

According to an embodiment of the present invention, the step of installing the double frames may include a step of installing W-shaped frames having double joining surfaces, in which wedge-shaped concave grooves of the upper frame at the outer side or inner side of the pillar are disposed side by side in two columns so as to form a W-shaped concave groove, wedge-shaped protrusions of the lower frame at the outer side or inner side of the pillar are disposed in two columns so as to form a W-shaped protrusion, and wedge-shaped protrusions of the vertical frame at the outer side or inner side of the pillar are disposed in two columns so as to form a W-shaped protrusion.

According to an embodiment of the present invention, the step of laying the blocks and the intermediate blocks may include a step of laying double blocks and double intermediate blocks on W-shaped frames at the outer side or inner side, in which, on the double frames formed by the step of forming the W-shaped frames having the double joining surfaces, double blocks, each having isosceles triangular wedge-shaped upper protrusions disposed in two columns throughout an upper surface so as to form a W-shaped upper protrusion, isosceles triangular wedge-shaped lower concave grooves disposed in two columns throughout a lower surface so as to form a W-shaped lower concave groove, isosceles triangular wedge-shaped side protrusions disposed in two columns throughout one side surface so as to form a W-shaped side protrusion, and isosceles triangular wedge-shaped side concave grooves disposed in two columns throughout the other side surface so as to form a W-shaped side concave groove, are, by the wedge-shaped upper protrusion and the wedge-shaped lower concave groove being fitted to each other, and the wedge-shaped side protrusion and the wedge-shaped side concave groove being fitted to each other, laid in a zigzag manner so that longitudinal side corners of the double blocks are positioned on a central portion of the upper surface or the lower surface of the double block stacked vertically adjacent thereto, and double intermediate blocks are fitted between the double blocks to change a direction in which the double blocks are laid, so that the W-shaped side concave groove of the double blocks is coupled to the W-shaped protrusion of the vertical frame, the double intermediate blocks each having isosceles triangular wedge-shaped upper protrusions disposed in two columns throughout an upper surface so as to form a W-shaped upper protrusion, isosceles triangular wedge-shaped lower concave grooves disposed in two columns throughout a lower surface so as to form a W-shaped lower concave groove, and isosceles triangular wedge-shaped side concave grooves disposed in two columns throughout both side surfaces so as to form a W-shaped side concave groove.

According to an embodiment of the present invention, the step of installing the horizontal reinforcing frames may include a step of installing horizontal reinforcing frames having a window frame integrally formed therewith, in which the horizontal reinforcing frames whose central portion is integrally formed with a window frame are mounted so as to be parallel to the upper frame and the lower frame.

According to an embodiment of the present invention, the insulation construction step may include a step of attaching a waterproof plywood, in which a waterproof plywood with an adhesive layer formed thereon is attached to a surface of the insulator panel.

According to an embodiment of the present invention, the step of laying the blocks and the intermediate blocks may include a step of laying blocks and intermediate blocks which have binding surfaces to which water-swellable water stop rubber is applied, in which the blocks and the intermediate block which have binding surfaces finished with water-swellable water stop rubber are laid.

Advantageous Effects

According to an embodiment of the present invention, a frame structure for fixing laid blocks is formed by frames fixed and installed in four directions on beams, slabs, and pillars by fastening materials, and the blocks are fitted and fixed to the frames. In this way, it is possible to solve a disadvantage of bricklaying work in that it is vulnerable to horizontal vibration.

According to an embodiment of the present invention, coupling between isosceles triangular wedge-shaped concave grooves and isosceles triangular wedge-shaped protrusions allows blocks to stand on their own. In this way, it is possible to improve workability of bricklaying work.

According to an embodiment of the present invention, small clearances are formed in coupling surfaces of wedge-shaped concave grooves and wedge-shaped protrusions formed on four sides, i.e., upper, lower, left, and right sides, of blocks so that, even when vibration occurs due to external impact, an earthquake, or the like, impact on the blocks can be mitigated, and, even when misalignment occurs between adjacent blocks or between the blocks and frames due to external impact, the blocks can be restored to their original positions along inclined surfaces of the wedge-shaped concave grooves and wedge-shaped protrusions, thereby improving seismic performance.

According to an embodiment of the present invention, the shapes of the wedge-shaped concave grooves and wedge-shaped protrusions form an isosceles triangular shape with an obtuse angle. In this way, it is possible to prevent damage on the frames and blocks due to a phenomenon in which stress is concentrated thereon.

According to an embodiment of the present invention, intermediate blocks are fitted between the blocks to change a direction of wedge-shaped side concave grooves formed on the blocks and allow wedge-shaped protrusions to be formed on side surfaces of vertical frames at both sides. In this way, it is possible to improve strength by an increase in a thickness of the vertical frames that serve as a frame structure of a wall structure.

According to an embodiment of the present invention, the isosceles triangular wedge-shaped concave grooves and isosceles triangular wedge-shaped protrusions, which are formed on the blocks, are coupled to wedge-shaped concave grooves or wedge-shaped protrusions of blocks or frames adjacent thereto in four directions, i.e., upper, lower, left, and right directions, and move integrally with pillars or slabs of a reinforced concrete structure. In this way, it is possible to improve watertightness, sound insulation, and windproofness even when coupling surfaces of the blocks are not adhered with an adhesive such as mortar.

According to an embodiment of the present invention, when laying the blocks and intermediate blocks, an adhesive such as a tile adhesive, a cement glue, or mortar is applied to each interface of the blocks and intermediate blocks. In this way, it is possible to construct coupling surfaces of the blocks with precision and form a dense structure in a wall so that the watertightness, sound insulation, and windproofness are further improved.

According to an embodiment of the present invention, adjacent blocks divided from each other by a vertical intermediate frame are firmly coupled by the same vertical intermediate frame. In this way, it is possible to prevent detachment of the blocks due to vibration and impact and improve seismic performance.

According to an embodiment of the present invention, coupling between W-shaped protrusions and W-shaped concave grooves allow firmer coupling between the blocks or between the blocks and frames. In this way, it is possible to more effectively prevent the detachment of the blocks due to vibration and impact.

According to an embodiment of the present invention, a horizontal reinforcing frame and a window frame are integrally manufactured. In this way, it is possible to allow a window to have structural strength, prevent damage to a structural wall that may occur in the process of constructing the window frame, and reduce the cost and time for installing the window frame.

According to an embodiment of the present invention, binding surfaces of the wedge-shaped protrusions and wedge-shaped concave grooves of the blocks and intermediate blocks are finished with water-swellable water stop rubber. In this way, it is possible to improve the watertightness, sound insulation, and windproofness according to use purpose and construct the binding surfaces with precision.

According to an embodiment of the present invention, a wall surface is divided into sections by the horizontal reinforcing frames and vertical intermediate frames. In this way, when the blocks are broken due to external impact, an earthquake, and the like, it is possible to replace only the corresponding broken section, thereby securing the efficiency of maintenance.

According to an embodiment of the present invention, the blocks and intermediate blocks, whose binding surfaces are finished with water-swellable water stop rubber, are stacked. In this way, it is possible to easily and promptly perform a bricklaying process for improving watertightness, sound insulation, and windproofness.

Figure 1A:
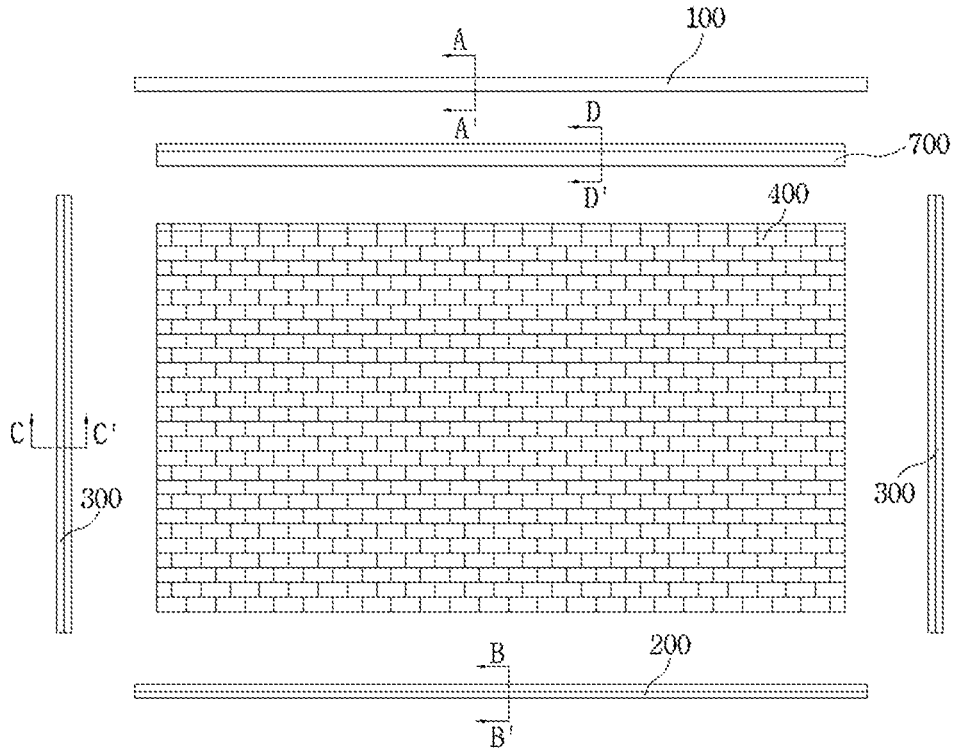
FIGS. 1A and 1B are views illustrating the overall configuration of a wall structure using blocks and frames each having a wedge-shaped coupling part formed therein according to an embodiment of the present invention.

Hereinafter, exemplary embodiments of the present invention will be described with reference to the accompanying drawings. Parts necessary to understand operations and actions according to the present invention will be mainly described in detail. In describing the exemplary embodiments of the present invention, description of details that are well-known in the art to which the present invention pertains and are not directly related to the present invention will be omitted. By omitting unnecessary description, the gist of the present invention can be more clearly delivered without being blurred.

In describing elements of the present invention, elements of the same names may be denoted by different reference numerals according to the drawings or denoted by the same reference numerals in different drawings. However, even in this case, it does not indicate that the corresponding element has different functions according to embodiments or has the same function in different embodiments. A function of each element should be determined on the basis of description of each element in the corresponding embodiment.

Unless otherwise defined, technical terms used herein have the same meaning as commonly understood by one of ordinary skill in the art to which the present invention pertains. The terms are not to be construed in an overly comprehensive or overly limiting sense.

In the specification, a singular expression includes a plural expression unless the context clearly indicates otherwise. In the application, terms such as "being formed of" or "including" does not necessarily mean including all of various elements or various steps described herein. The terms may indicate that some of the elements or steps are not included or additional elements or steps are further included.

Figure 1B:
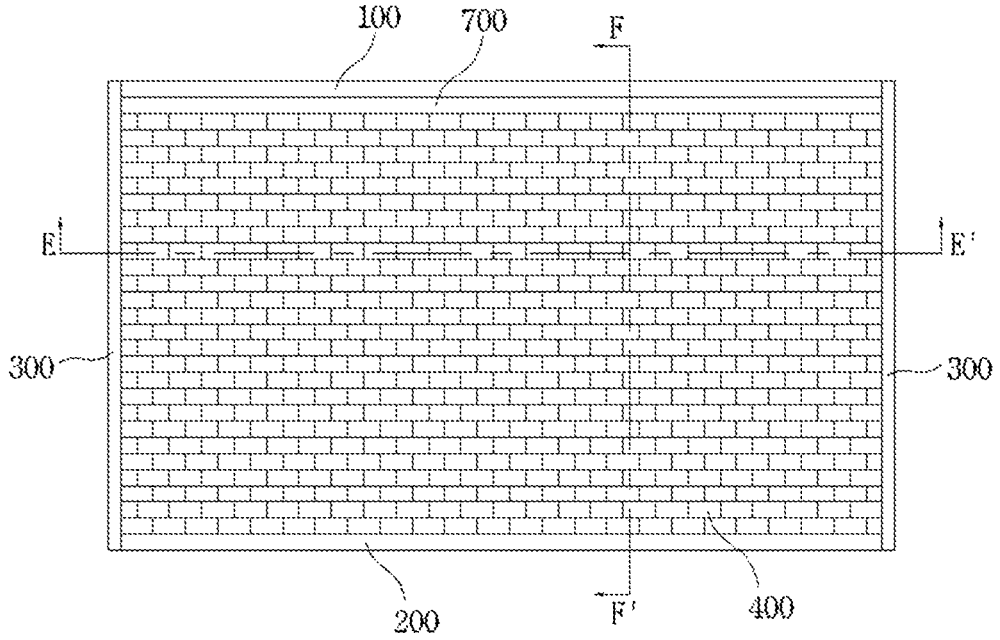
Figure 2A:
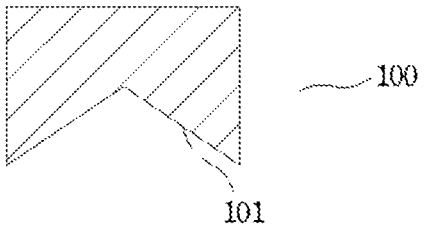
FIGS. 2A-2D are views illustrating a cross-sectional shape of a frame according to an embodiment of the present invention.
Figure 2B:
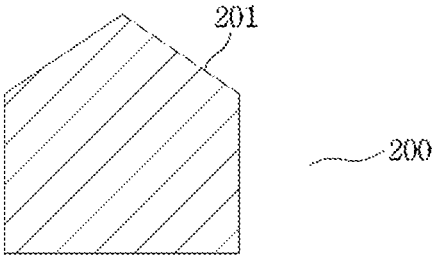
Figure 2C:
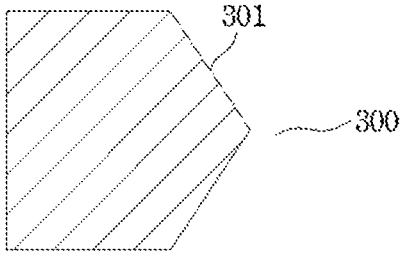
Figure 2D:
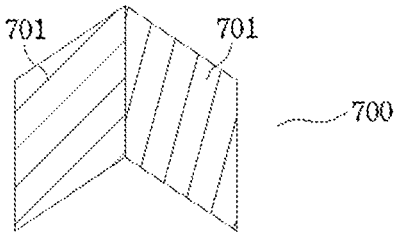

In a wall structure using blocks and frames each having a wedge-shaped coupling part formed therein according to a first embodiment of the present invention, as illustrated in FIGS. 1A and 1B, an upper frame 100 is fixed and mounted on a surface of a beam of a building by a fastening material, a lower frame 200 is fixed and mounted on a surface of a slab by a fastening material, and vertical frames 300 fixed and mounted on surfaces of pillars by a fastening material have upper and lower ends connected to ends of the upper frame 100 and the lower frame 200, respectively. As illustrated in FIG. 2A, an isosceles triangular wedge-shaped concave groove 101 is formed throughout a lower surface of the upper frame 100 (which means the same as "throughout the thickness and width of the lower surface of the upper frame 100." Hereinafter, expressions having the same or similar meanings as "throughout the thickness and width of" will be uniformly referred to as "throughout."), wherein a corner of the wedge-shaped concave groove 101 is parallel to a longitudinal direction of the beam. As illustrated in FIG. 2B, an isosceles triangular wedge-shaped protrusion 201 is formed throughout an upper surface of the lower frame 200, wherein a corner of the wedge-shaped protrusion 201 is parallel to a longitudinal direction of the slab. As illustrated in FIG. 2C, an isosceles triangular wedge-shaped protrusion 301 is formed throughout an inner side surface of the vertical frames 300 at both sides, wherein a corner of the wedge-shaped protrusion 301 is parallel to a height direction of the pillar.

Figure 4A:
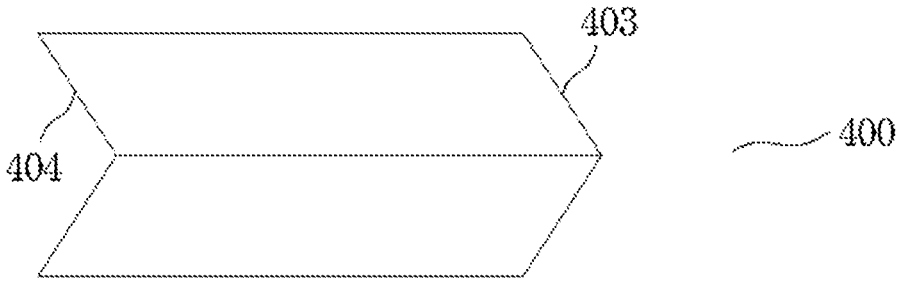
FIGS. 4A to 4C are views illustrating a plane view, a front view, and a side view of a block, respectively, according to an embodiment of the present invention.
Figure 4B:
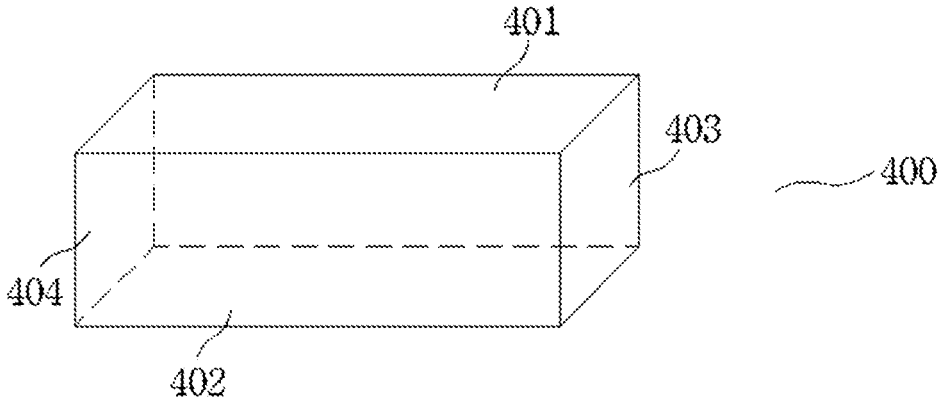
Figure 4C:
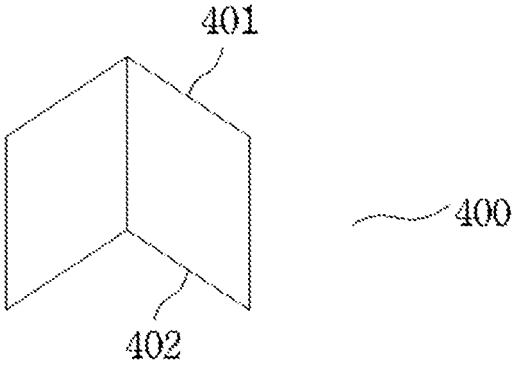

Also, blocks 400 are laid by being fitted between the upper frame 100, the lower frame 200, and the vertical frames 300. As illustrated in FIGS. 4A-4C, the blocks 400 each have an isosceles triangular wedge-shaped upper protrusion 401 formed throughout an upper surface, an isosceles triangular wedge-shaped lower concave groove 402 formed throughout a lower surface, and an isosceles triangular wedge-shaped side protrusion 403 and an isosceles triangular wedge-shaped side concave groove 404 formed throughout both side surfaces.

Here, the wedge-shaped upper protrusions 401 and the wedge-shaped lower concave grooves 402 of adjacent blocks 400 are fitted to each other, the wedge-shaped side protrusions 403 and the wedge-shaped side concave grooves 404 of adjacent blocks 400 are fitted to each other, and the blocks 400 are laid in a zigzag manner so that longitudinal side corners of the blocks 400 are positioned on a central portion of the upper surface or the lower surface of the block 400 stacked vertically adjacent thereto. As illustrated in FIGS. 1A and 1B, to allow the vertical frames 300 and the blocks 400 to be completely coupled without a gap therebetween even when the blocks 400 are disposed in a zigzag manner, blocks 400, of which ever other one has a short length, are applied as the blocks 400 coupled to the vertical frames 300.

Figure 3A:
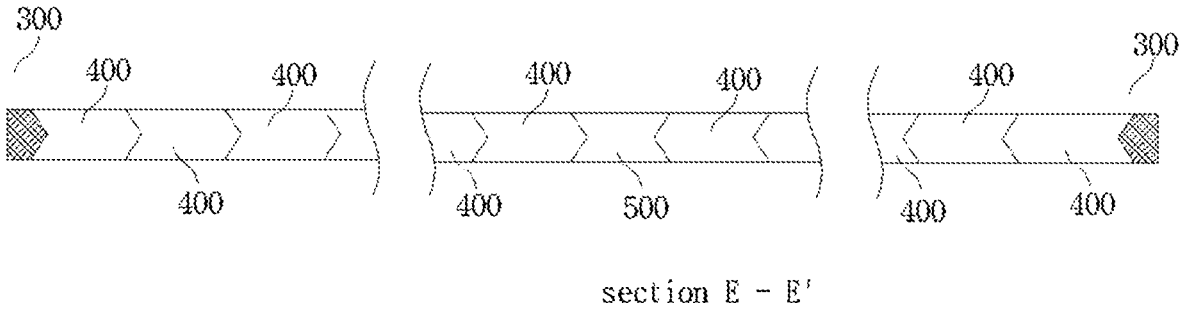
FIGS. 3A-3B are views illustrating a cross-sectional shape of a wall structure using blocks and frames each having a wedge-shaped coupling part formed therein according to an embodiment of the present invention.
Figure 5A:
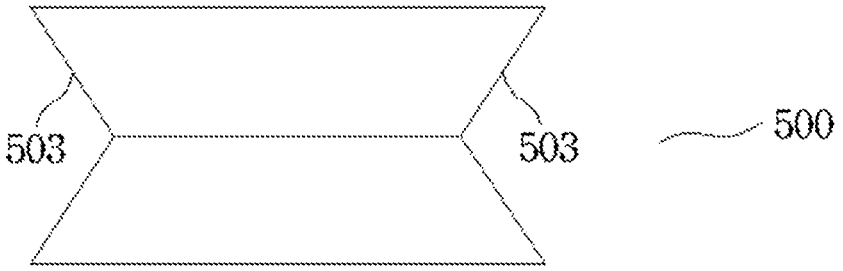
FIGS. 5A to 5C are views illustrating a front view and a side view of an intermediate block, respectively, according to an embodiment of the present invention.
Figure 5B:
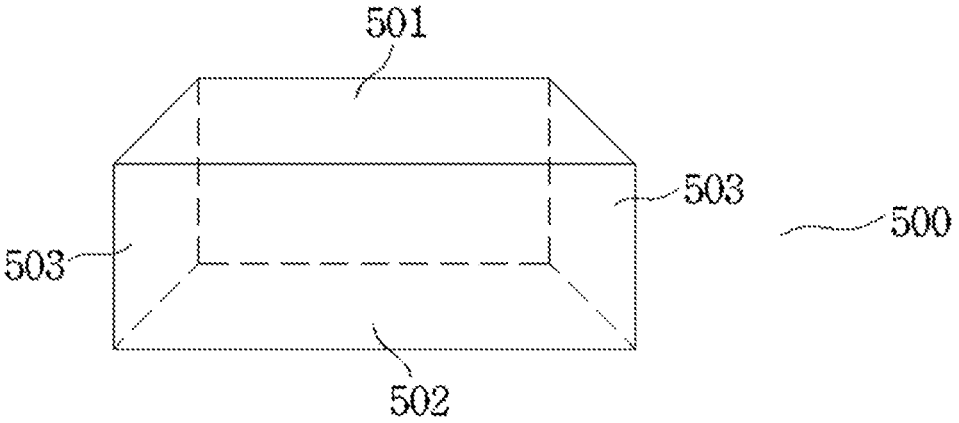
Figure 5C:
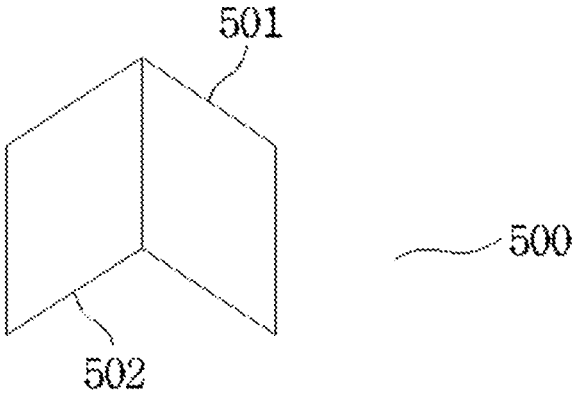

Also, as illustrated in FIG. 3A, intermediate blocks 500 are fitted between the blocks 400 to change a direction in which the blocks 400 are laid and allow the wedge-shaped side concave grooves 404 of the blocks 400 to be coupled to the wedge-shaped protrusions 301 of the vertical frames 300. As illustrated in FIGS. 5A to 5C, the intermediate blocks 500 each have an isosceles triangular wedge-shaped upper protrusion 501 formed throughout an upper surface, an isosceles triangular wedge-shaped lower concave groove 502 formed throughout a lower surface, and an isosceles triangular wedge-shaped side concave groove 503 formed throughout both side surfaces.

Figure 3B:
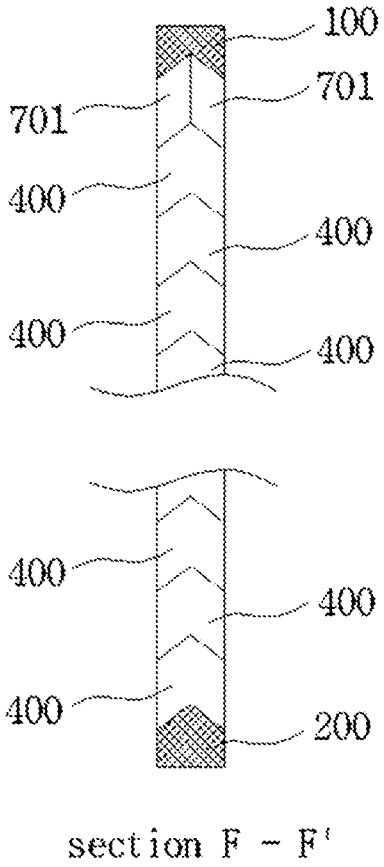
Figure 6A:
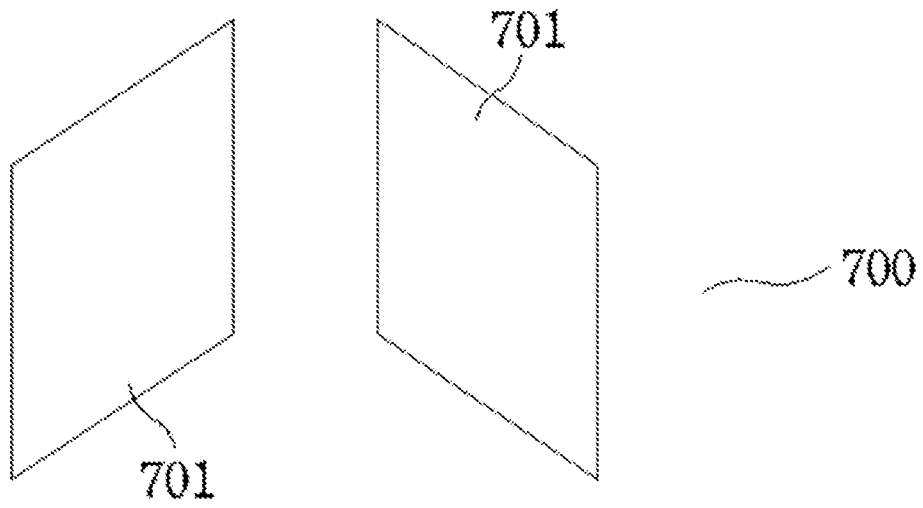
FIGS. 6A and 6B are views illustrating a shape of a finish frame according to an embodiment of the present invention.
Figure 6B:
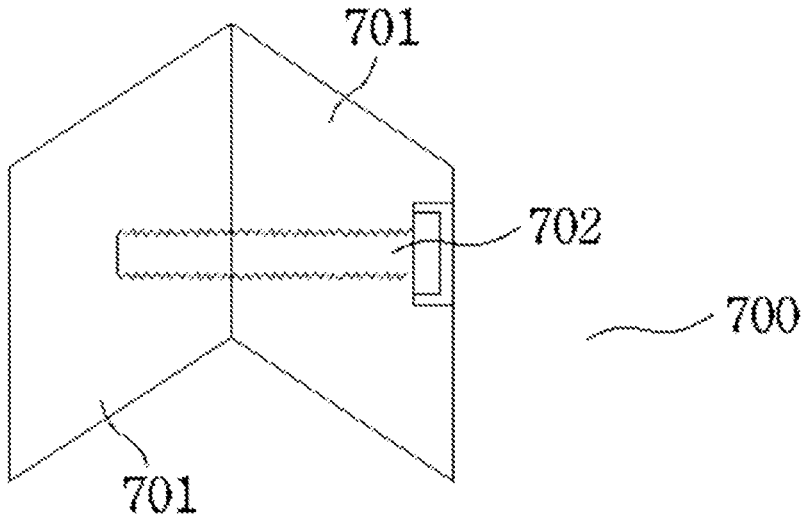

Also, as illustrated in FIG. 3B, a finish frame 700 is mounted in a space between the uppermost end portions of the laid blocks 400 and the upper frame 100 so as to fix the blocks 400 at the uppermost end portion and the upper frame 100. In this way, the blocks 400 are firmly coupled to the upper frame 100, the lower frame 200, and the vertical frames 300. As illustrated in FIGS. 6A and 6B, the finish frame 700 is formed of two frame bodies 701 which have a rhombic cross-section and are symmetrical to each other. The frame bodies 701 are fitted from the inner side and outer side into the space between the blocks 400 at the uppermost end portion and the upper frame 100, an upper surface of the frame body 701 is engaged to come in close contact with the wedge-shaped concave groove 101 of the upper frame 100, a lower surface of the frame body 701 is engaged to come in close contact with the wedge-shaped upper protrusion 401 of the block 400 laid at the uppermost end portion, and a frame body fastener 702 passes through and fastens side surface parts of the two frame bodies 701, thereby fixing the frame bodies 701.

Figure 7A:
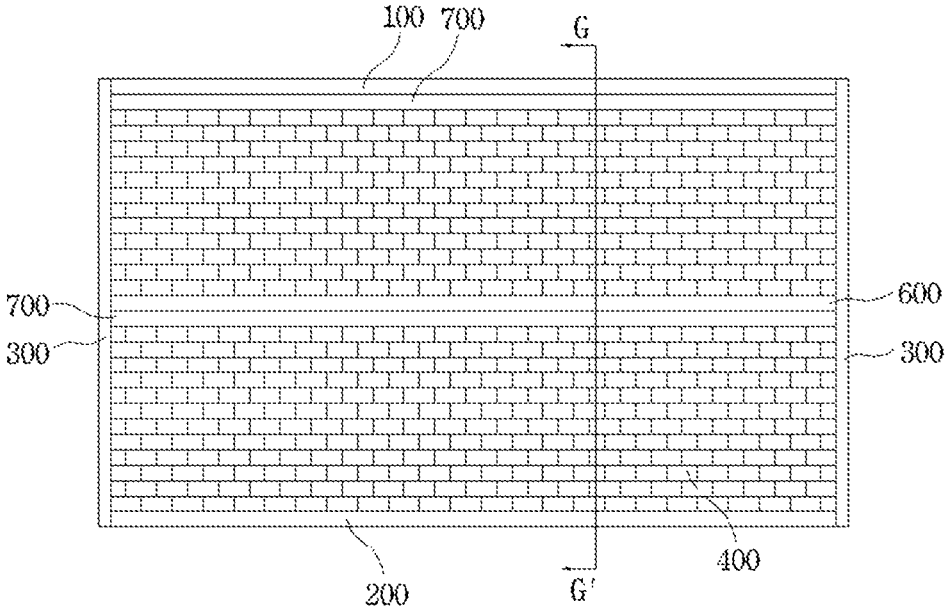
FIGS. 7A and 7B are views illustrating the overall configuration of a wall structure using blocks and frames each having a wedge-shaped coupling part formed therein according to an embodiment of the present invention.
Figure 7B:
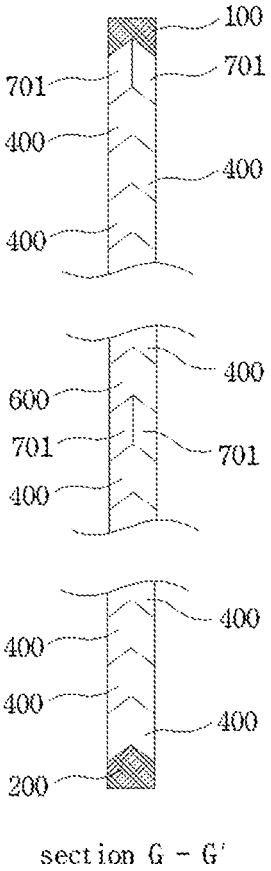

A wall structure using blocks and frames each having a wedge-shaped coupling part formed therein according to a second embodiment of the present invention has the same configuration as in the first embodiment. As illustrated in FIGS. 7A and 7B, one or more horizontal reinforcing frames 600 are mounted between the upper frame 100 and the lower frame 200 of the first embodiment so as to be parallel to the upper frame 100 and the lower frame 200. The one or more horizontal reinforcing frames 600 each have an isosceles triangular wedge-shaped protrusion 601 formed throughout an upper surface and an isosceles triangular wedge-shaped concave groove 602 formed throughout a lower surface, wherein corners of the wedge-shaped protrusion 601 and the wedge-shaped concave groove 602 are parallel to the longitudinal direction of the upper frame 100 and the lower frame 200.

Here, layers are formed within the frames due to installing the horizontal reinforcing frames 600. By fitting the finish frame 700, which has been described above in relation to the first embodiment, in a space between the laid blocks 400 and the lower surfaces of the horizontal reinforcing frames 600, the upper surface of the frame body 701 is engaged to come in close contact with the wedge-shaped concave groove 600 of the horizontal reinforcing frame 600, the lower surface of the frame body 701 is engaged to come in close contact with the wedge-shaped upper protrusion 401 of the block 400 laid on the uppermost end portion, and the frame body 701 is fixed by the frame body fastener 702.

Figure 8A:
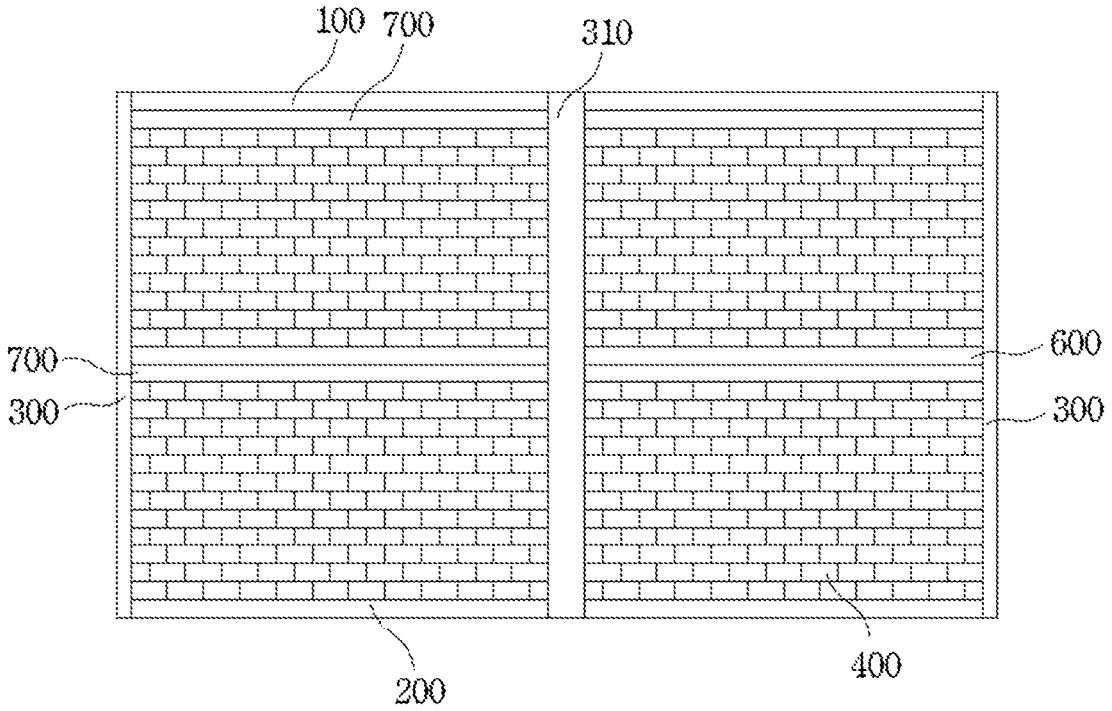
FIGS. 8A-8B are views illustrating the overall configuration of a wall structure using blocks and frames each having a wedge-shaped coupling part formed therein according to an embodiment of the present invention.
Figure 8B:
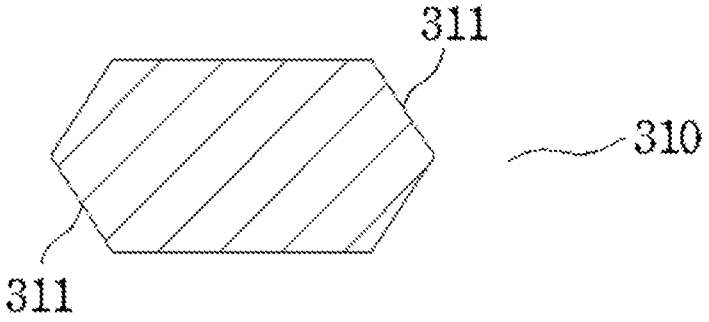

A wall structure using blocks and frames each having a wedge-shaped coupling part formed therein according to a third embodiment of the present invention has the same configuration as in the second embodiment. As illustrated in FIGS. 8A-8B, one or more vertical intermediate frames 310 are installed between the vertical frames 300 at both sides, an upper end and a lower end of the vertical intermediate frame 310 are connected and coupled to a surface of a beam and a surface of a slab, respectively, and both side ends of the horizontal reinforcing frame 600 are fixed to side surfaces of the vertical frames 300 and the vertical intermediate frames 310 by a fastening material. As illustrated in FIG. 8B, the one or more vertical intermediate frames 310 each have an isosceles triangular wedge-shaped protrusion 311 formed throughout both side surfaces, wherein a corner of the wedge-shaped protrusion 311 is parallel to a height direction of the pillar, and the wedge-shaped protrusion 311 of the vertical intermediate frame 310 is engaged to come in close contact with the wedge-shaped side concave groove 404 of the block 400 laid within the frames.

A wall structure using blocks and frames each having a wedge-shaped coupling part formed therein according to a fourth embodiment of the present invention has the same configuration as in the first to third embodiments, the isosceles triangular wedge-shaped protrusions and the isosceles triangular wedge-shaped concave grooves of the frames, the blocks 400, and the intermediate blocks 500 form an obtuse angle. By the wedge-shaped protrusions and the wedge-shaped concave grooves forming an isosceles triangular shape with an obtuse angle, it is possible to prevent damage on the frames and blocks due to a phenomenon in which stress is concentrated thereon.

A wall structure using blocks and frames each having a wedge-shaped coupling part formed therein according to a fifth embodiment of the present invention has the same configuration as in the first to third embodiments, and binding surfaces of the blocks 400 and the intermediate blocks 500 are finished with water-swellable water stop rubber. The water-swellable water stop rubber is a material that swells upon coming in contact with moisture. Because the water-swellable water stop rubber may be stably adhered to various materials such as concrete or metal, the water-swellable water stop rubber may be applied to surfaces of the blocks 400 and the intermediate blocks 500. When the water-swellable water stop rubber swells due to moisture in a state in which laying of the blocks 400 and the intermediate blocks 500 is completed, clearances between binding surfaces of the blocks 400 and the intermediate blocks 500 are completely blocked such that it is possible to further improve sound insulation, windproofness, and waterproofness of a wall formed by the laid blocks.

Figure 9:
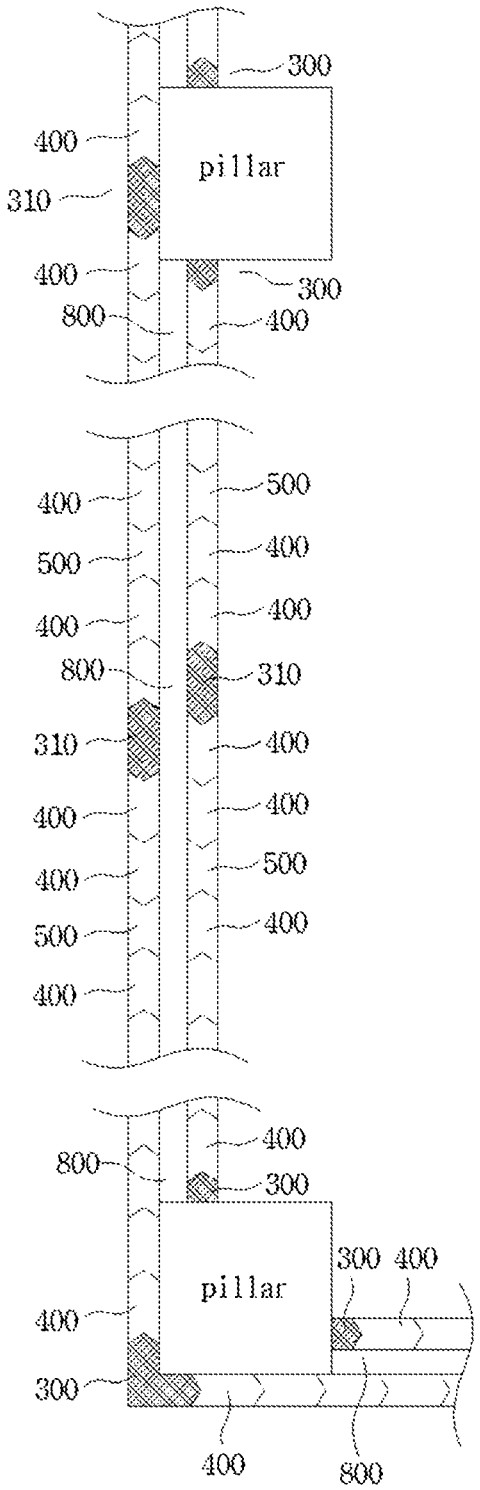
FIG. 9 is a view illustrating a cross-sectional shape of a double wall structure according to an embodiment of the present invention.

A wall structure using blocks and frames each having a wedge-shaped coupling part formed therein according to a sixth embodiment of the present invention has the same configuration as in the first to third embodiments. As illustrated in FIG. 9, the upper frame 100, the lower frame 200, and the vertical frames 300 of the first embodiment, the horizontal reinforcing frames 600 of the second embodiment, and the vertical intermediate frames 310 of the third embodiment are each formed of a double structure. The upper frame 100, the lower frame 200, and the vertical frame 300 which are at an outer side come in close contact toward the outside of an outer side surface of a pillar and the upper frame 100, the lower frame 200, and the vertical frame 300 which are at an inner side are spaced apart toward the inside of the outer side surface of the pillar such that a space is formed between the outside and inside frames. An insulator panel 800 is attached to the space between the outside and inside frames such that the insulator panel 800 is positioned between walls formed by the blocks 400 laid on the outside and inside frames.

Here, as illustrated in FIG. 9, the vertical frame 300 installed at the outer side of a pillar at an outer boundary of the building is bent in an L-shape such that a bent inner side surface of the vertical frame 300 is mounted to come in close contact with an outer corner of the pillar at the outer boundary, and wall surfaces neighboring each other with respect to the outer side pillar share the vertical frame 300.

Figure 10A:
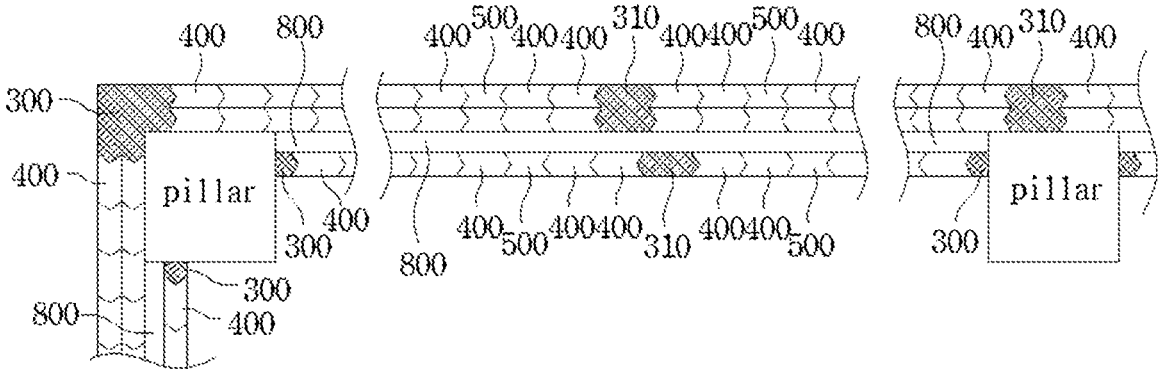
FIGS. 10A-10C are views illustrating a cross-sectional shape of a wall structure to which double frames are applied according to an embodiment of the present invention.
Figure 10B:
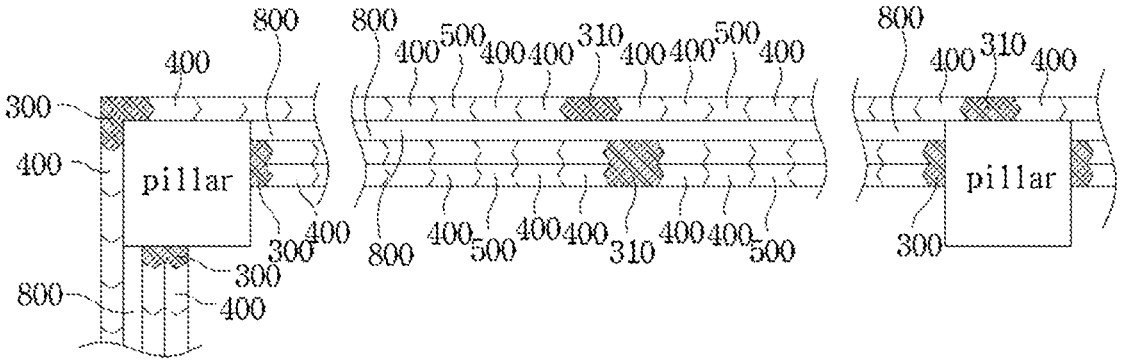
Figure 10C:
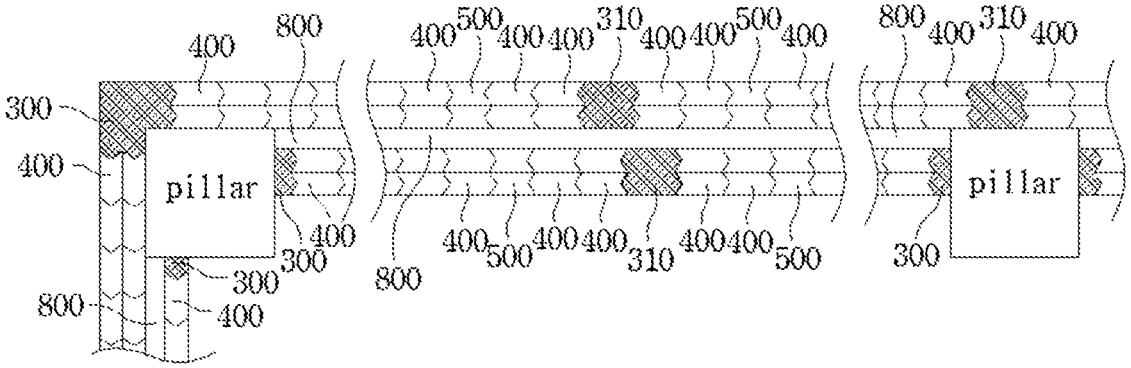
Figure 14A:
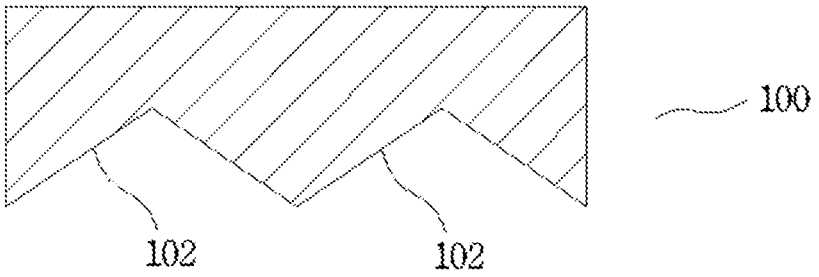
FIGS. 14A to 14C are views illustrating a cross-sectional structure of a double frame according to an embodiment of the present invention.
Figure 14B:
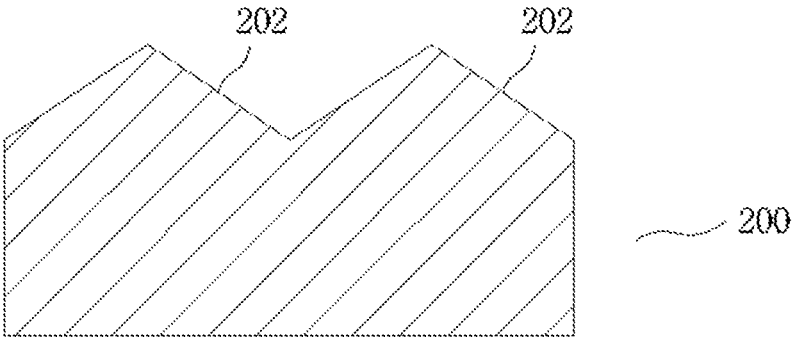
Figure 14C:
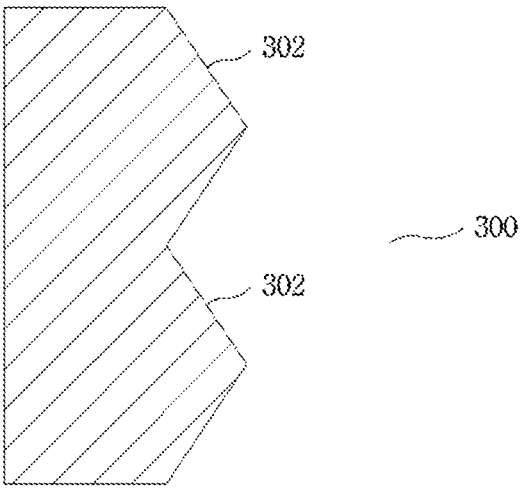

A wall structure using blocks and frames each having a wedge-shaped coupling part formed therein according to a seventh embodiment of the present invention has the same configuration as in the sixth embodiment. As illustrated in FIGS. 10A-10C, the outer side or inner side frames are formed of a double structure. As illustrated in FIG. 14A, wedge-shaped concave grooves 101 of the upper frame 100 at the outer side or inner side of the pillar are disposed side by side in two columns so as to form a W-shaped concave groove 102. As illustrated in FIG. 14B, wedge-shaped protrusions 201 of the lower frame 200 at the outer side or inner side of the pillar are disposed in two columns so as to form a W-shaped protrusion 202. As illustrated in FIG. 14C, wedge-shaped protrusions 301 of the vertical frames 300 at the outer side or inner side of the pillar are disposed in two columns so as to form a W-shaped protrusion 302. Two corners formed in the W-shaped concave groove 102 are parallel to the longitudinal direction of the upper frame 100, two corners formed in the W-shaped protrusion 202 are parallel to the longitudinal direction of the lower frame 200, and two corners formed in the W-shaped protrusion 302 are parallel to the height direction of the vertical frame 300.

Figure 11A:
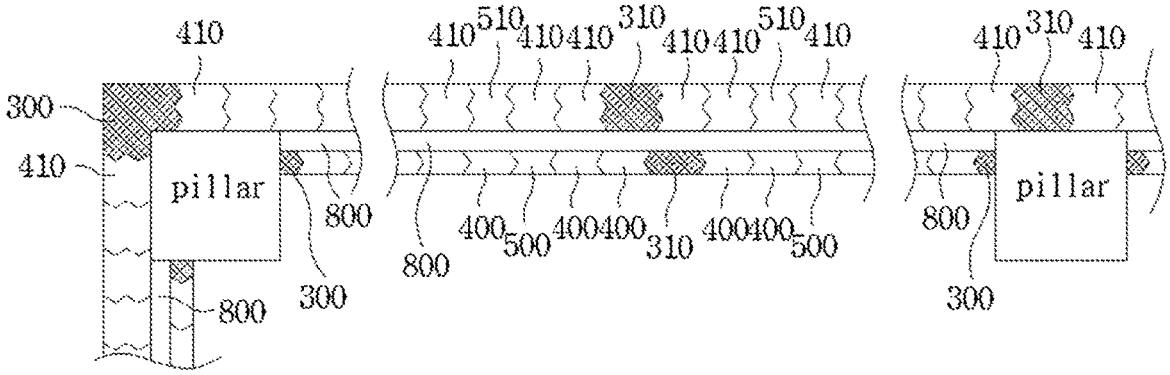
FIGS. 11A to 11C are views illustrating a cross-sectional shape of a wall structure to which double frames, in which double blocks and double intermediate blocks are laid, are applied according to an embodiment of the present invention.
Figure 11B:
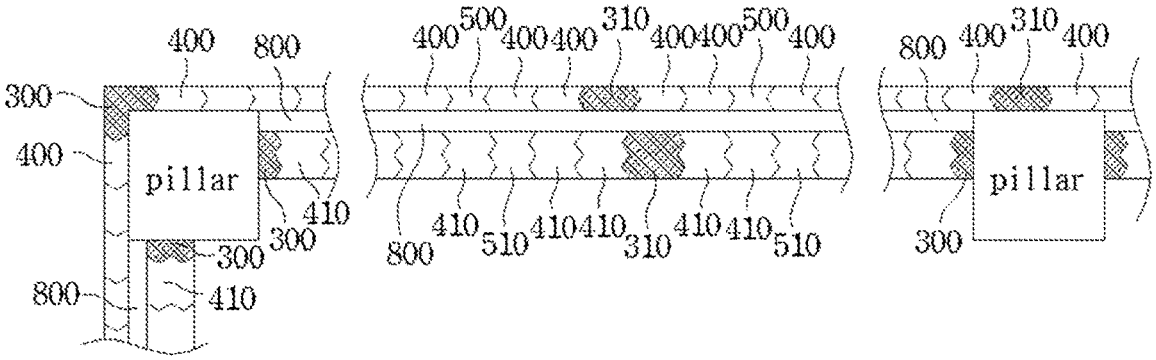
Figure 11C:
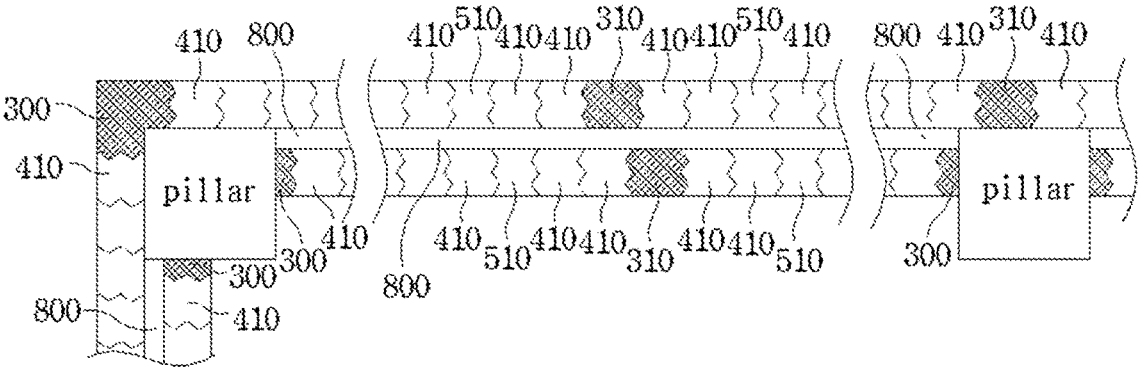
Figure 12A:
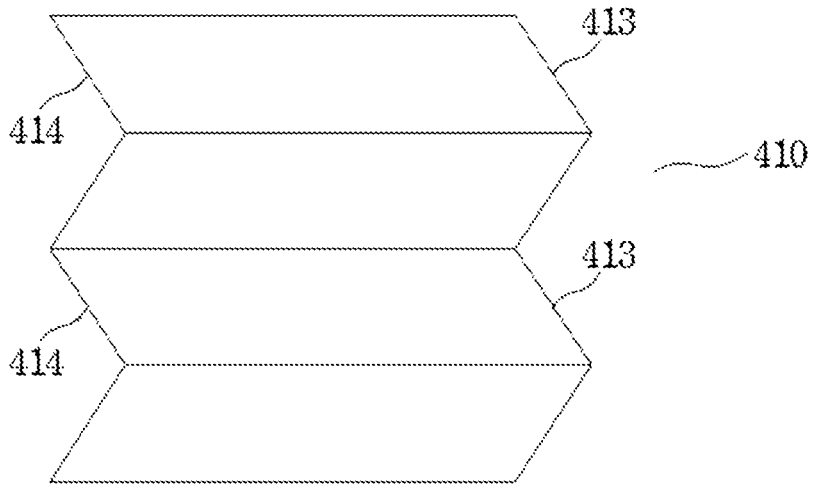
FIGS. 12A to 12C are views illustrating a front view and a side view of a double block according to an embodiment of the present invention.
Figure 12B:
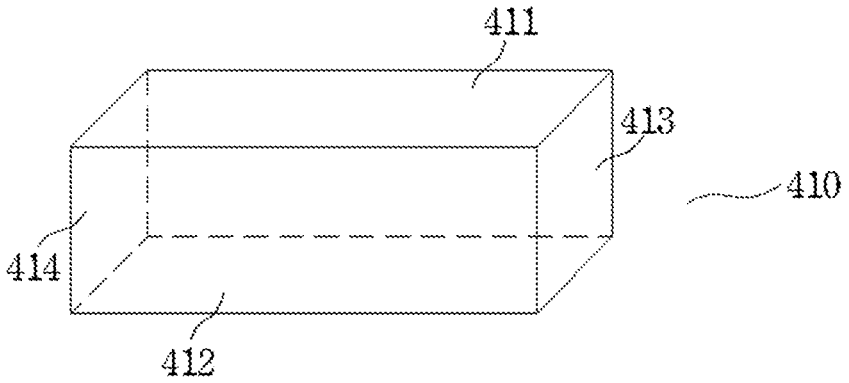
Figure 12C:
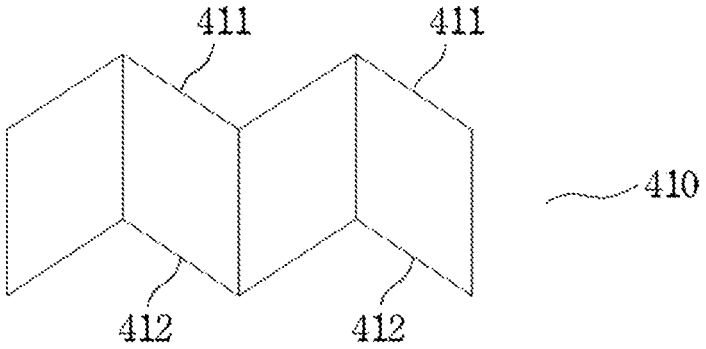

A wall structure using blocks and frames each having a wedge-shaped coupling part formed therein according to an eighth embodiment of the present invention has the same configuration as in the seventh embodiment. As illustrated in FIGS. 11A-11C, double blocks 410 and double intermediate blocks 510 are stacked on the outer side or inner side frames formed of the double structure according to the sixth embodiment. As illustrated in FIGS. 12A-12C, the double blocks 410 each have isosceles triangular wedge-shaped upper protrusions 401 disposed in two columns throughout an upper surface so as to form a W-shaped upper protrusion 411, isosceles triangular wedge-shaped lower concave grooves 402 disposed in two columns throughout a lower surface so as to form a W-shaped lower concave groove 412, isosceles triangular wedge-shaped side protrusions 403 disposed in two columns throughout one side surface so as to form a W-shaped side protrusion 413, and isosceles triangular wedge-shaped side concave grooves 404 disposed in two columns throughout the other side surface so as to form a W-shaped side concave groove 414.

Figure 13A:
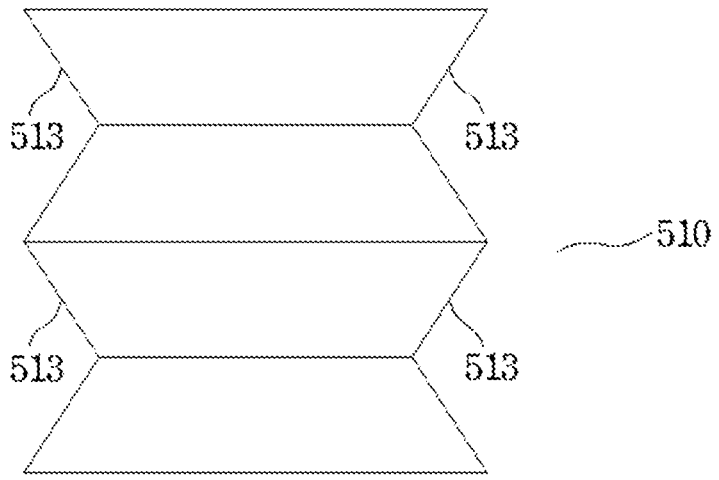
FIGS. 13A to 13C are views illustrating a front view and a side view of a double intermediate block according to an embodiment of the present invention.
Figure 13B:
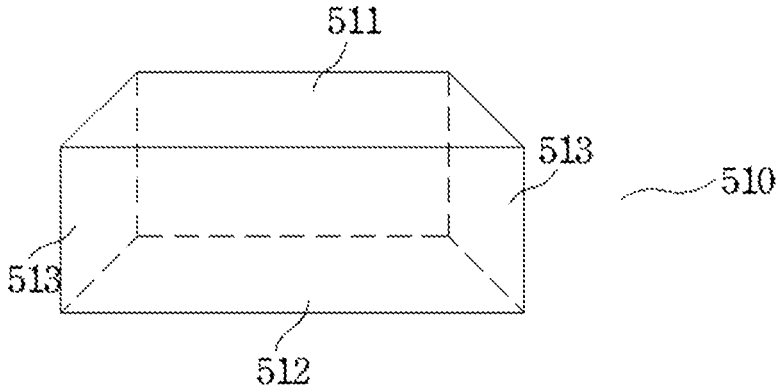
Figure 13C:
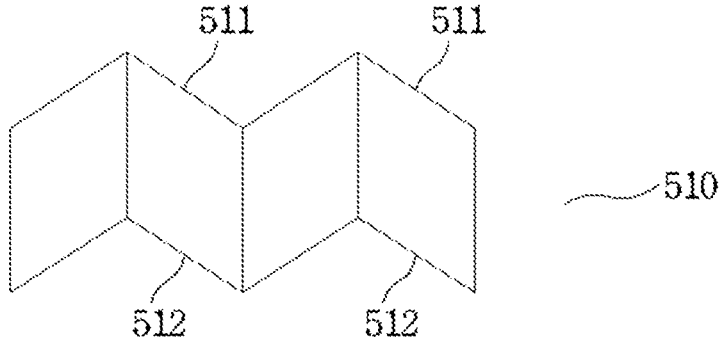

Also, as illustrated in FIGS. 13A-13C, the double intermediate blocks 510 each have isosceles triangular wedge-shaped upper protrusions 501 disposed in two columns throughout an upper surface so as to form a W-shaped upper protrusion 511, isosceles triangular wedge-shaped lower concave grooves 501 disposed in two columns throughout a lower surface so as to form a W-shaped lower concave groove 512, and isosceles triangular wedge-shaped side concave grooves 503 disposed in two columns throughout both side surfaces so as to form a W-shaped side concave groove 513.

Here, the double blocks 410 are laid in a zigzag manner so that longitudinal side corners of the double blocks 410 are positioned on a central portion of the upper surface or the lower surface of the double block 410 stacked vertically adjacent thereto. The wedge-shaped upper protrusions 411 and the wedge-shaped lower concave grooves 412 are fitted and coupled to each other, and the wedge-shaped side protrusions 413 and the wedge-shaped side concave grooves 414 are fitted and coupled to each other between the laid double blocks 410. The double intermediate blocks 510 are fitted between the laid double blocks 410 and change a direction in which the double blocks 410 are laid, so that the W-shaped side concave groove 414 of the laid double block 410 may be coupled to the W-shaped protrusion 302 of the vertical frame 300.

Also, to allow the vertical frames 300 and the double blocks 410 to be completely coupled without a gap therebetween even when the double blocks 410 are disposed in a zigzag manner, double blocks 410, of which ever other one has a short length, are applied as the double blocks 410 coupled to the vertical frames 300.

Figure 15A:
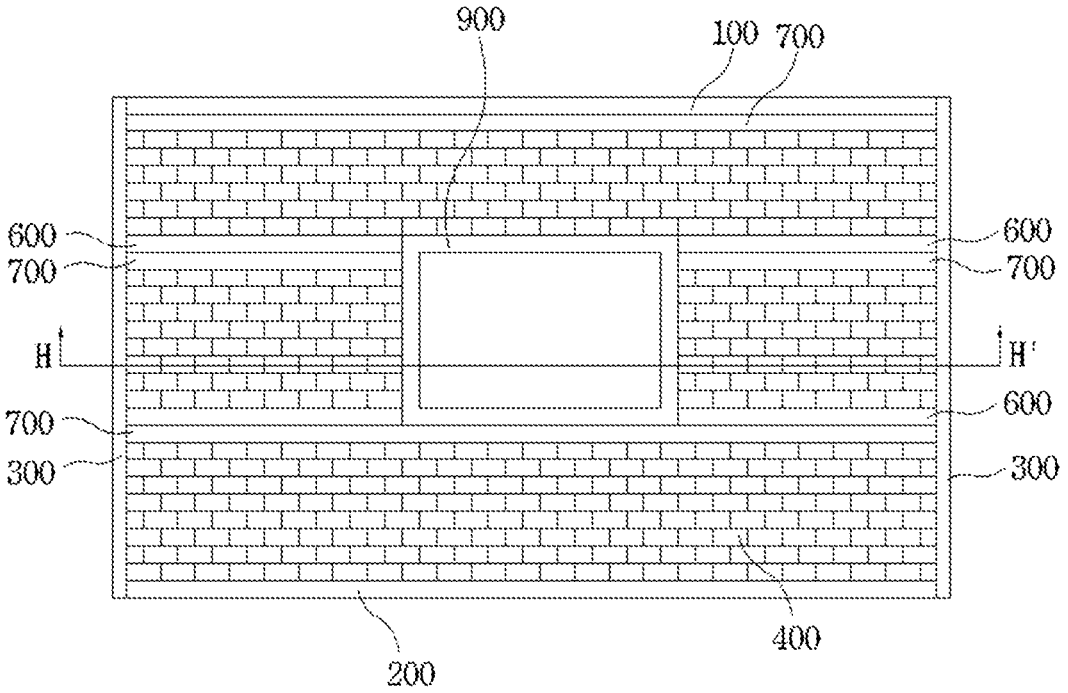
FIGS. 15A and 15B are views illustrating the overall configuration of a wall structure to which frames each integrally formed with a window frame are applied according to an embodiment of the present invention.
Figure 15B:
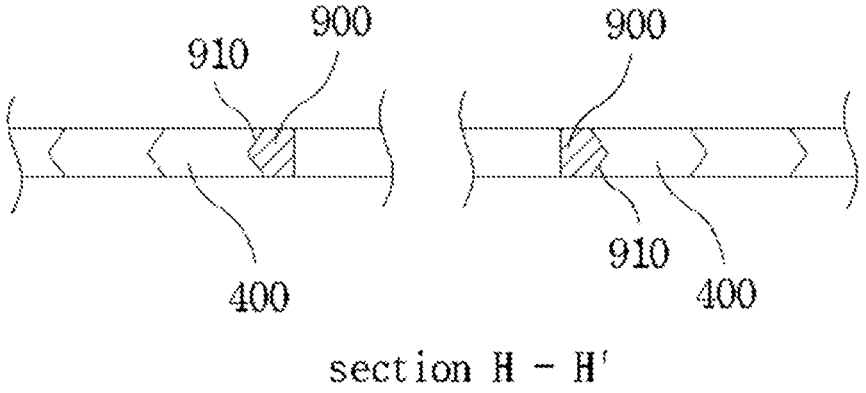

A wall structure using blocks and frames each having a wedge-shaped coupling part formed therein according to a ninth embodiment of the present invention has the same configuration as in the second or third embodiment. As illustrated in FIG. 15, a window frame 900 is integrally formed at a central portion of the horizontal reinforcing frames 600, and the window frame 900 has an isosceles triangular wedge-shaped protrusion 901 formed throughout both side surfaces so as to head toward the vertical frames 300 at both sides. This allows the wedge-shaped side concave groove 404 of the block 400 laid on a frame and the wedge-shaped protrusion 901 of the window frame 900 to be coupled and fixed to each other.

Figure 16:
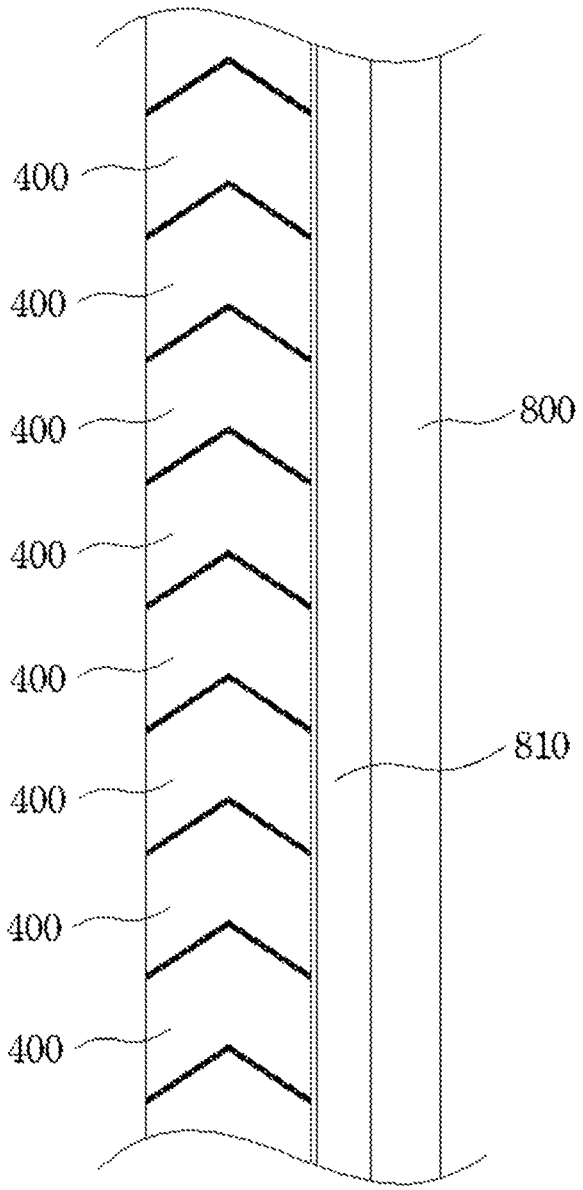
FIG. 16 is a view illustrating a block stacking structure in which an adhesive is applied to coupling surfaces of the blocks according to an embodiment of the present invention.

A wall structure using blocks and frames each having a wedge-shaped coupling part formed therein according to a tenth embodiment of the present invention has the same configuration as in the sixth embodiment. As illustrated in FIG. 16, a waterproof plywood 810 with an adhesive layer formed thereon is attached to a surface of the insulator panel 800.

A method of constructing the wall structure of the present invention configured as described above is as follows.

Figure 17:
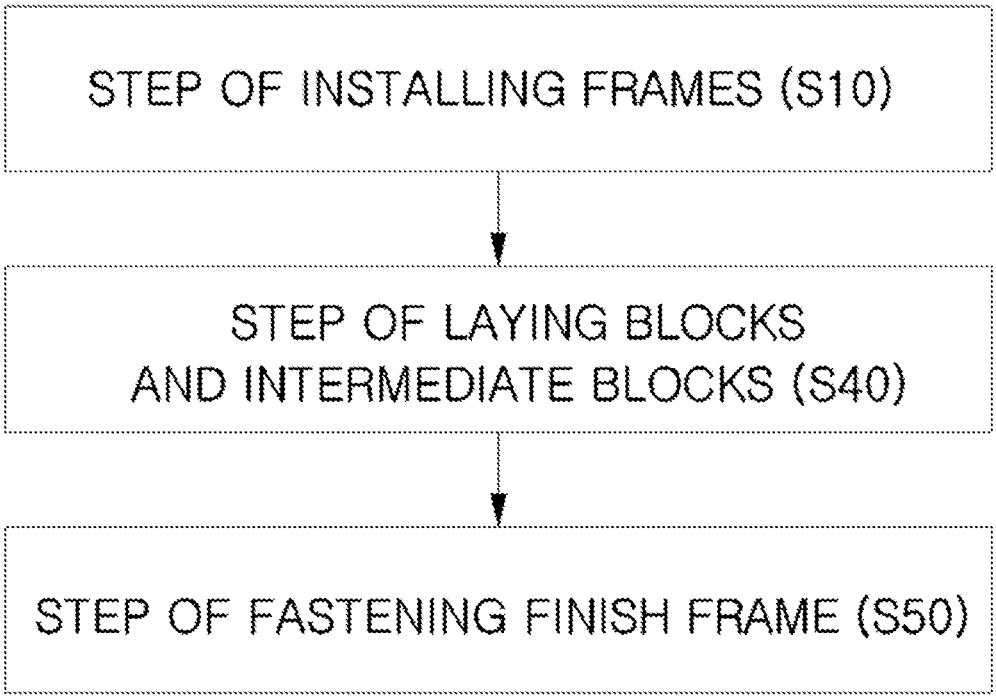
FIGS. 17 to 26 are views illustrating process flowcharts of a method of constructing a wall using blocks and frames each having a wedge-shaped coupling part formed therein according to an embodiment of the present invention.

As illustrated in FIG. 17, a method of constructing a wall using blocks and frames each having a wedge-shaped coupling part formed therein according to an eleventh embodiment of the present invention includes a step of installing frames (S10), a step of laying blocks and intermediate blocks (S40), and a step of fastening a finish frame (S50). In the step of installing the frames (S10), an upper frame 100 is fixed and mounted on a surface of a beam by a fastening material, a lower frame 200 is fixed and mounted on a surface of a slab by a fastening material, and vertical frames 300 are fixed and mounted on inner side surfaces of pillars by a fastening material so that ends of the upper frame 100 and the lower frame 200 are connected to ends of the vertical frames 300.

Here, the step of installing the frames (S10) is completed by installing the upper frame 100, which has an isosceles triangular wedge-shaped concave groove 101 formed throughout a lower surface, so that a corner of the wedge-shaped concave groove 101 is parallel to a longitudinal direction of the beam, installing the lower frame 200, which has an isosceles triangular wedge-shaped protrusion 201 formed throughout an upper surface, so that a corner of the wedge-shaped protrusion 201 is parallel to a longitudinal direction of the slab, and installing the vertical frames 300, each of which has an isosceles triangular wedge-shaped protrusion 301 formed throughout an inner side surface, so that a corner of the wedge-shaped protrusion 301 is parallel to a height direction of the pillar.

When the step of installing the frames (S10) is completed, the step of laying the blocks and intermediate blocks (S40) is performed in which blocks 400 are laid within the frames and intermediate blocks 500 are fitted between the blocks 400. The blocks 400 each have an isosceles triangular wedge-shaped upper protrusion 401 formed throughout an upper surface, an isosceles triangular wedge-shaped lower concave groove 402 formed throughout a lower surface, and an isosceles triangular wedge-shaped side protrusion 403 and an isosceles triangular wedge-shaped side concave groove 404 formed throughout both side surfaces. The blocks 400 are laid such that the wedge-shaped upper protrusions 401 and the wedge-shaped lower concave grooves 402 of adjacent blocks 400 are fitted to each other, and the wedge-shaped side protrusions 403 and the wedge-shaped side concave grooves 404 of adjacent blocks 400 are fitted to each other. The blocks 400 are laid in a zigzag manner so that longitudinal side corners of the laid blocks 400 are positioned on a central portion of the upper surface or the lower surface of the block 400 stacked vertically adjacent thereto. To allow the vertical frames 300 and the blocks 400 to be completely coupled without a gap therebetween when the blocks 400 are disposed in a zigzag manner, blocks 400, of which ever other one has a short length, are applied as the blocks 400 coupled to the vertical frames 300.

Here, even when vertical and horizontal vibrations occur, the frames fixed and mounted on the beam, slab, and pillars by the fastening materials serve as a frame structure and prevent collapse of a wall constructed by laying the blocks. Particularly, the wedge-shaped upper protrusion 401, the wedge-shaped lower concave groove 402, the wedge-shaped side protrusion 403, and the wedge-shaped side concave groove 404 of the block 400 which are formed in four directions, i.e., the upper, lower, left, and right directions, cause adjacent blocks 400 to be coupled in the four directions and are fitted to wedge-shaped concave grooves or wedge-shaped protrusions formed in frames to allow the frames and the blocks 400 to move integrally with pillars or slabs of a reinforced concrete structure. In this way, detachment of the blocks 400 due to vibration and impact is prevented, thereby improving seismic performance.

Also, even when coupling surfaces of the blocks 400 and the intermediate blocks 500 are not adhered with an adhesive such as mortar, firm coupling is possible between the frames, the blocks 400, and the intermediate blocks 500 by coupling between the wedge-shaped protrusions and wedge-shaped concave grooves formed in the frames, blocks 400, and the intermediate blocks 500. In this way, watertightness, sound insulation, and windproofness may be improved as compared with a wall constructed using a conventional bricklaying construction method.

Also, coupling between wedge-shaped concave grooves or wedge-shaped protrusions formed in the frames and the blocks 400 allows the blocks 400 to stand on their own, thereby further facilitating the bricklaying construction. Small clearances are formed in coupling surfaces of wedge-shaped concave grooves and wedge-shaped protrusions formed on four sides, i.e., upper, lower, left, and right sides, of the blocks 400 so that, even when vibration occurs due to external impact, an earthquake, or the like, the blocks 400 slightly move and impact on the blocks 400 is mitigated. Even when misalignment occurs between the blocks 400 or between the blocks 400 and frames due to strong external impact, inclined surfaces with which the wedge-shaped concave grooves and wedge-shaped protrusions come in contact allow the weights of the blocks 400 to act as a restoring force that makes central points of adjacent blocks 400 match or central points of the blocks 400 and frames match, thereby allowing the blocks 400 to be restored to their original positions and further improving the seismic performance.

The intermediate blocks 500 are fitted between the stacked blocks 400. To change a direction in which the blocks 400 are laid, so that the wedge-shaped side concave groove 404 of the block 400 may be coupled to the wedge-shaped protrusion 301 of the vertical frames 300 at both sides, the intermediate block 500 has an isosceles triangular wedge-shaped upper protrusion 501 formed throughout an upper surface, an isosceles triangular wedge-shaped lower concave groove 502 formed throughout a lower surface, and an isosceles triangular wedge-shaped side concave groove 503 formed throughout both side surfaces.

Here, the intermediate blocks 500 allow the wedge-shaped side concave groove 404 of the block 400 to head toward the vertical frames 300 at both sides, thereby allowing the wedge-shaped protrusion 301 to be formed at side surfaces of the vertical frames 300 at both sides. Because a thickness of the vertical frame 300 is increased as compared with when forming a wedge-shaped concave groove in the vertical frame 300, it is possible to increase strength of the vertical frame 300 that also serves as a frame structure of the wall structure according to the present invention.

Also, preferably, the shapes of the wedge-shaped concave grooves and wedge-shaped protrusions, which are formed in the frames, the blocks 400, and the intermediate blocks 500, form an isosceles triangular shape with an obtuse angle. When the isosceles triangular shape with an obtuse angle is applied, the phenomenon in which stress is concentrated on the corners is minimized, and it is possible to prevent the wedge-shaped concave grooves and the wedge-shaped protrusions of the frames, the blocks 400, and the intermediate blocks 500 from breaking when external impact is applied.

When the step of laying the blocks and the intermediate blocks (S40) is completed, the step of fastening the finish frame (S50) is performed in which a finish frame 700, which is formed of two frame bodies 701 having a rhombic cross-section and symmetrical to each other, is mounted in a space between the uppermost end portion of the laid blocks 400 and the upper frame 100. The step of fastening the finish frame (S50) is completed by fitting the two frame bodies 701 from the inner side and outer side into the space between the blocks 400 at the uppermost end portion and the upper frame 100 so that an upper surface of the frame body 701 is engaged to come in close contact with the wedge-shaped concave groove 101 of the upper frame 100 and a lower surface of the frame body 701 is engaged to come in close contact with the wedge-shaped upper protrusion 401 of the block 400 laid on the uppermost end portion, and then making a frame body fastener 702 pass through and fasten side surface parts of the two frame bodies 701, thereby fixing the frame bodies 701.

Figure 18:
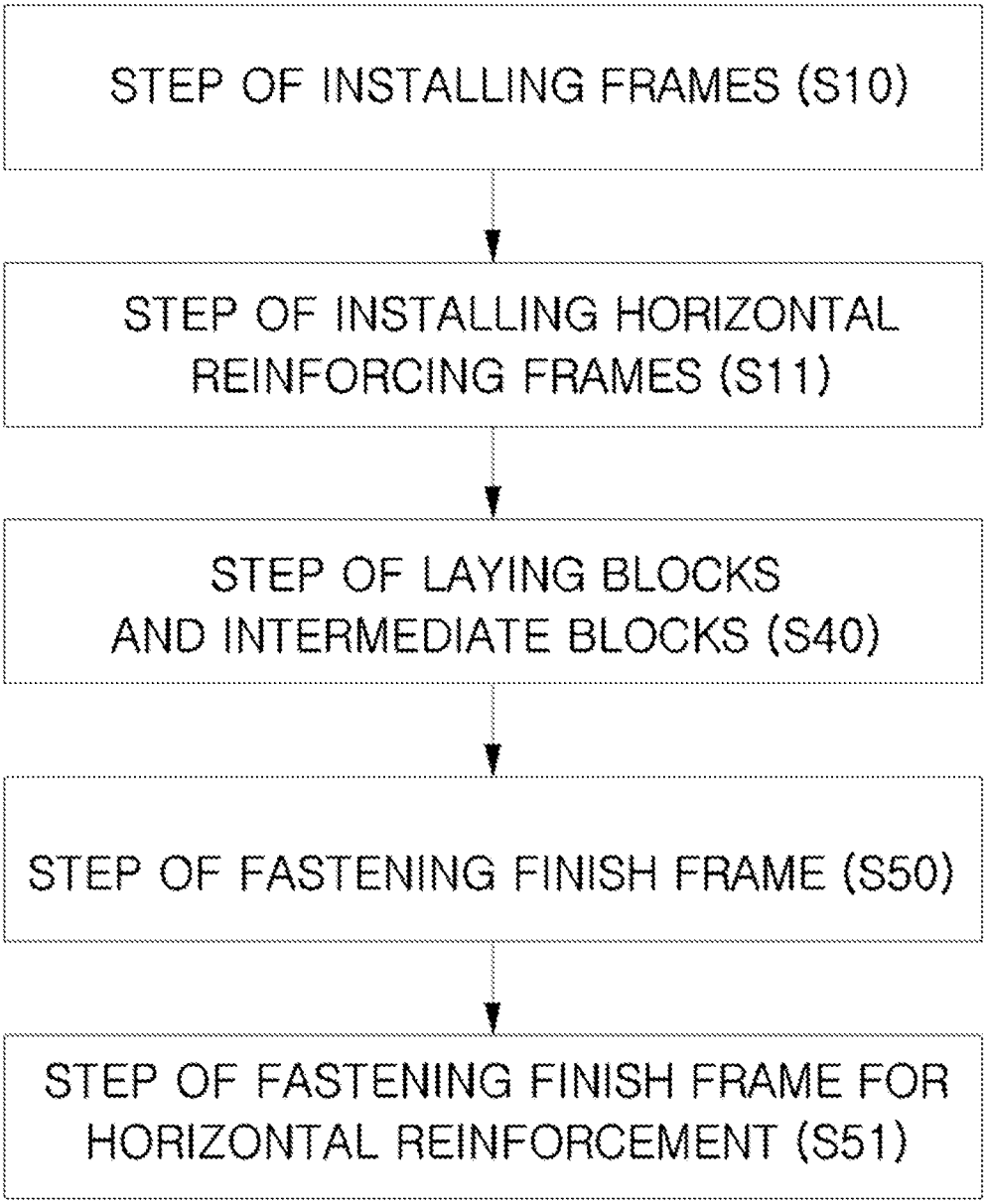

A method of constructing a wall using blocks and frames each having a wedge-shaped coupling part formed therein according to a twelfth embodiment of the present invention is the same as the construction method according to the eleventh embodiment. As illustrated in FIG. 18, the step of installing the frames (S10) includes a step of installing horizontal reinforcing frames (S11), in which one or more horizontal reinforcing frames 600 are mounted between the upper frame 100 and the lower frame 200 so as to be parallel to the upper frame 100 and the lower frame 200. Because the one or more horizontal reinforcing frames 600 each have an isosceles triangular wedge-shaped protrusion 601 formed throughout an upper surface and an isosceles triangular wedge-shaped concave groove 602 formed throughout a lower surface, the step of fastening the finish frame (S50), which is performed after the step of laying the blocks and the intermediate blocks (S40), includes a step of fastening a finish frame for horizontal reinforcement (S51), in which the finish frame 700 is fitted and fixed between the wedge-shaped upper protrusions 401 of the blocks 400, which are laid on each layer formed by the horizontal reinforcing frames 600, and the wedge-shaped concave grooves 602 of the horizontal reinforcing frames 600.

Figure 19:
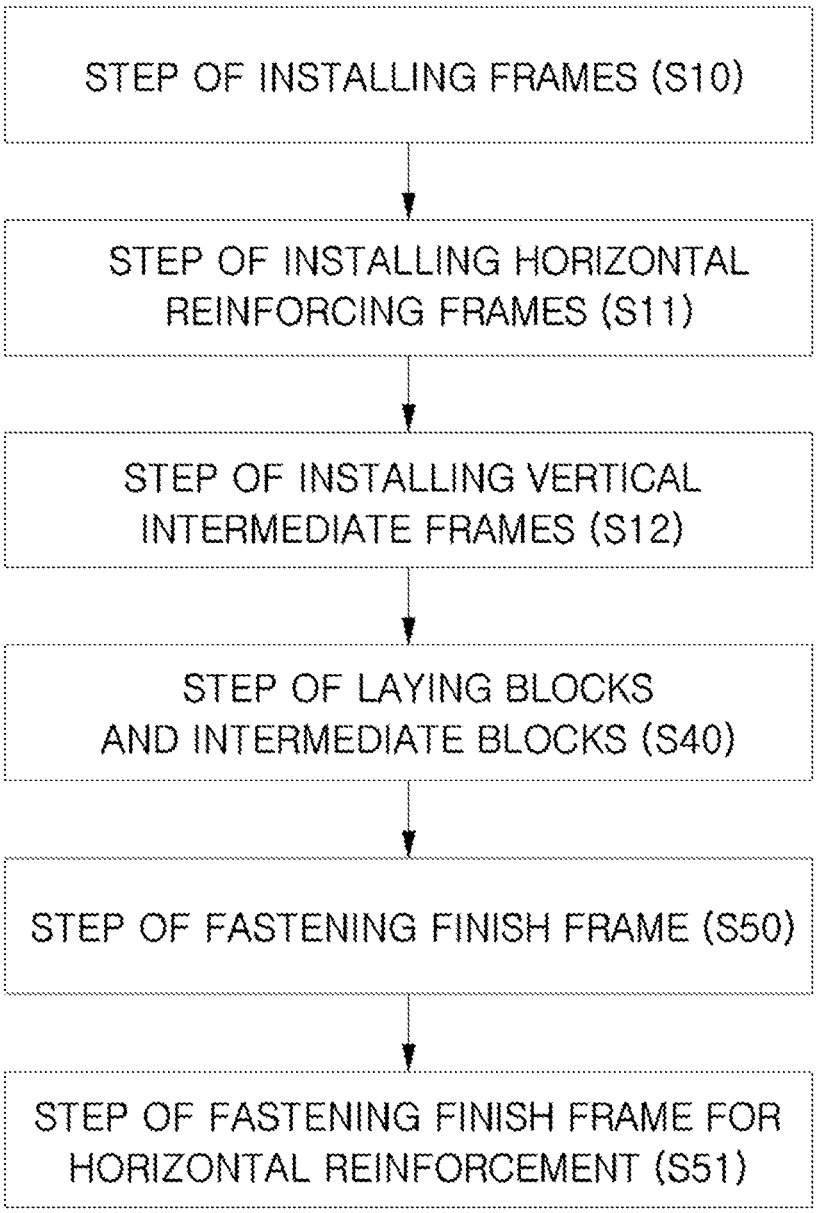

A method of constructing a wall using blocks and frames each having a wedge-shaped coupling part formed therein according to a thirteenth embodiment of the present invention is the same as the construction method according to the twelfth embodiment. As illustrated in FIG. 19, after the step of installing the horizontal reinforcing frames (S11) is completed, a step of installing vertical intermediate frames (S12) is performed in which one or more vertical intermediate frames 310 are mounted between the vertical frames 300 at both sides. The vertical intermediate frame 310 has an upper end and a lower end directly connected and coupled to a surface of a beam and a surface of slab, respectively, and an isosceles triangular wedge-shaped protrusion 311 formed throughout both side surfaces.

Here, by both side ends of the horizontal reinforcing frames 600 being fixed to side surfaces of the vertical frames 300 and the vertical intermediate frames 310 by a fastening material, a wall surface is divided into sections by the vertical intermediate frames 310 and the horizontal reinforcing frames 600. In this way, when the blocks 400 are broken due to external impact, an earthquake, and the like, it is possible to replace only the corresponding broken section, thereby securing the efficiency of maintenance. By causing the blocks 400 to be fixed by the same vertical intermediate frame 310 in adjacent sections so that the blocks 400 are firmly coupled, it is possible to prevent detachment of the blocks 400 due to vibration and impact and improve seismic performance.

Figure 20:
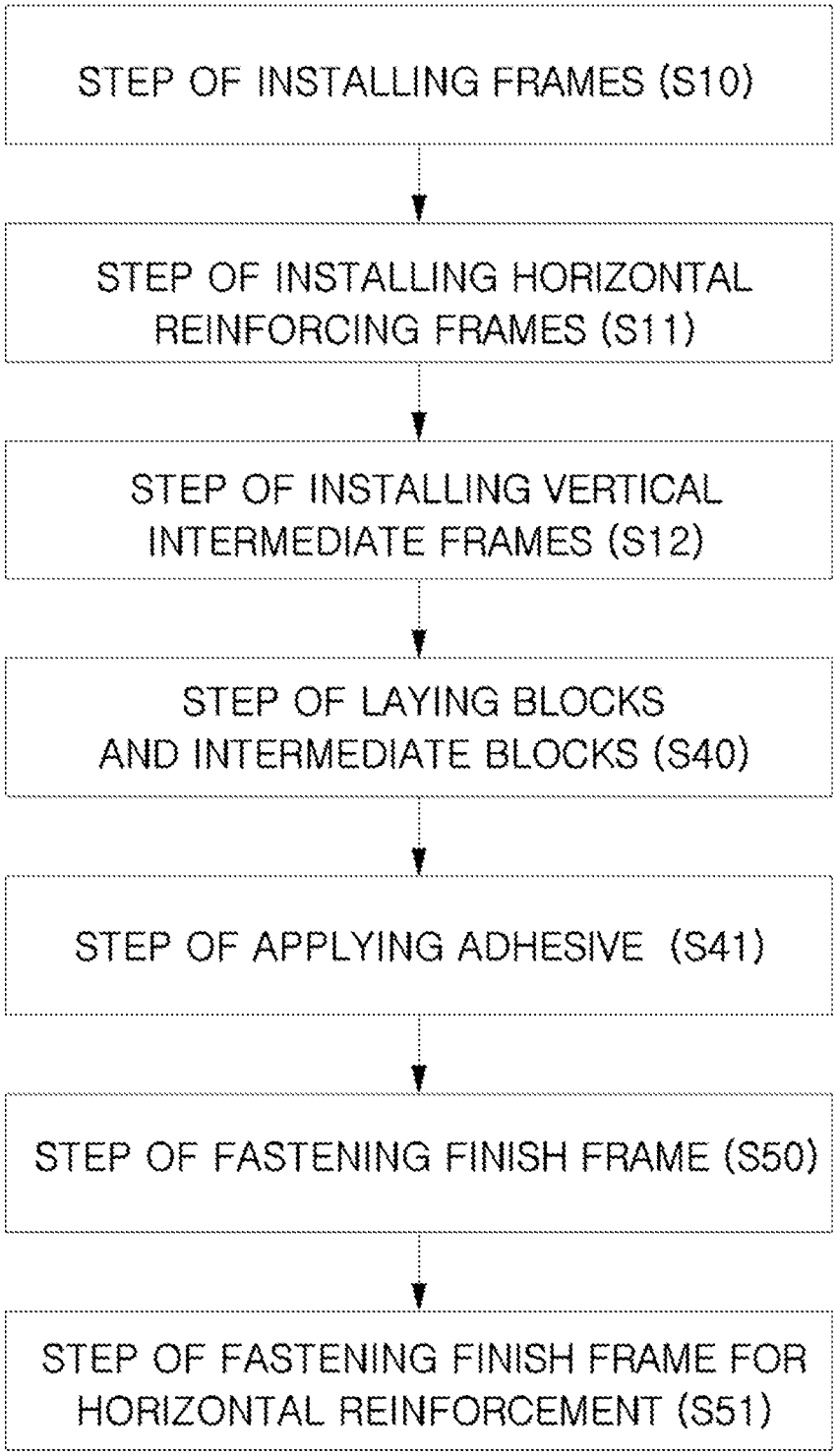

A method of constructing a wall using blocks and frames each having a wedge-shaped coupling part formed therein according to a fourteenth embodiment of the present invention is the same as the construction method according to the eleventh to thirteenth embodiments and is a construction method applied to walls for which sound insulation, windproofness, and waterproofness are important. As illustrated in FIG. 20, the step of laying the blocks and the intermediate blocks (S40) includes a step of applying an adhesive (S41), in which the blocks 400 and the intermediate blocks 500 are laid after an adhesive, such as a tile adhesive, a cement glue, or mortar, is applied on each interface of the blocks 400 and the intermediate blocks 500. As illustrated in FIG. 16, by applying an adhesive to the interfaces of the blocks 400 and the intermediate blocks 500, it is possible to construct coupling surfaces of the blocks 400 and the intermediate blocks 500 with precision by blocking a gap therebetween and form a wall having a dense structure, thereby further improving sound insulation, windproofness, and waterproofness between the blocks 400 and the intermediate blocks 500.

Figure 21:
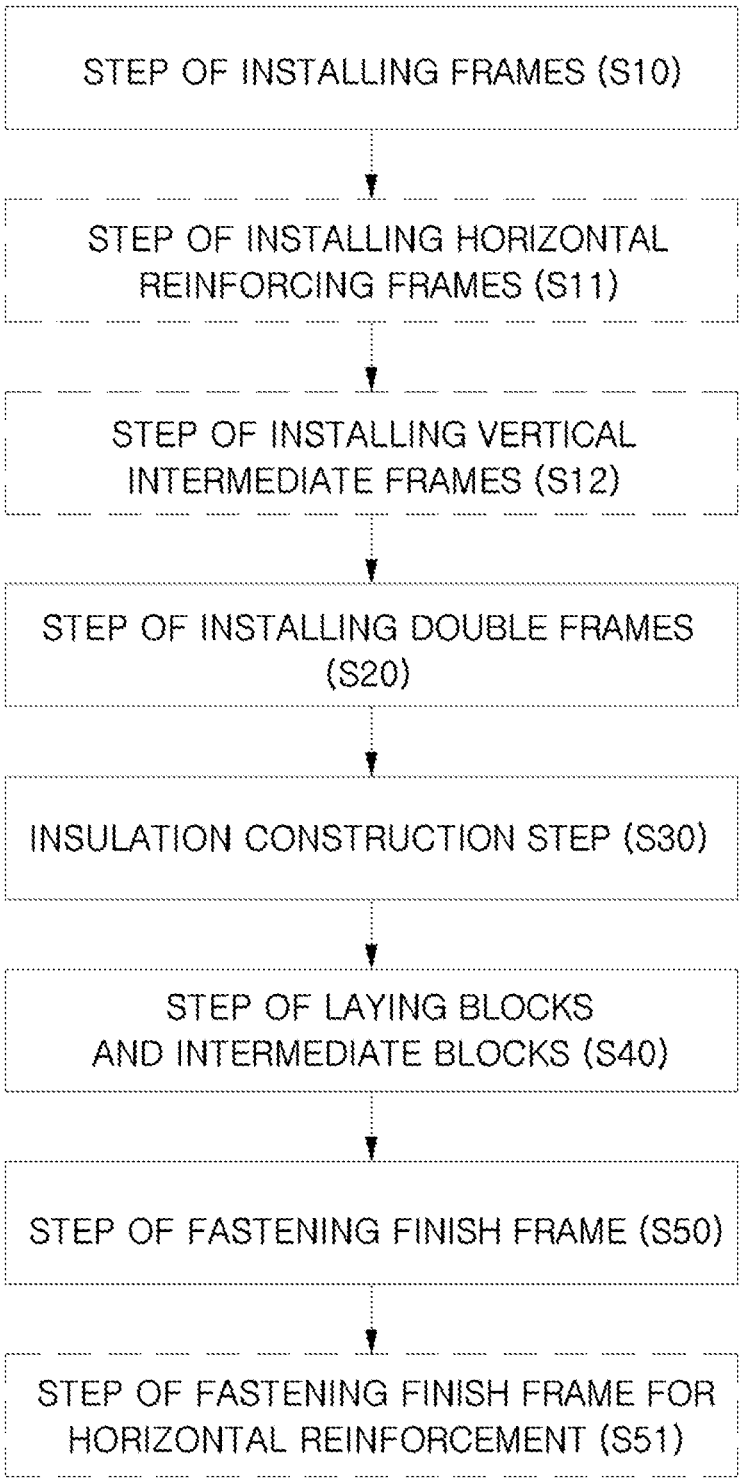

A method of constructing a wall using blocks and frames each having a wedge-shaped coupling part formed therein according to a fifteenth embodiment of the present invention is the same as the construction method according to the eleventh to thirteenth embodiments. As illustrated in FIG. 21, the step of installing the frames (S10) includes a step of installing double frames (S20), in which the frames are formed in a double layer at an outer side and an inner side. In the step of installing the double frames (S20), the upper frame 100, the lower frame 200, and the vertical frame 300 which are at the outer side are installed to come in close contact toward the outside of an outer side surface of a pillar and the upper frame 100, the lower frame 200, and the vertical frame 300 which are at an inner side are installed to be spaced apart toward the inside of the outer side surface of the pillar so that a space is formed between the frames at the outer side and the frames at the inner side. After the step of installing the double frames (S20) is completed, an insulation construction step (S30) in which an insulator panel 800 is attached to the double frames is performed before performing the step of laying the blocks and the intermediate blocks (S40). In this way, it is possible to improve insulation performance.

Figure 22:
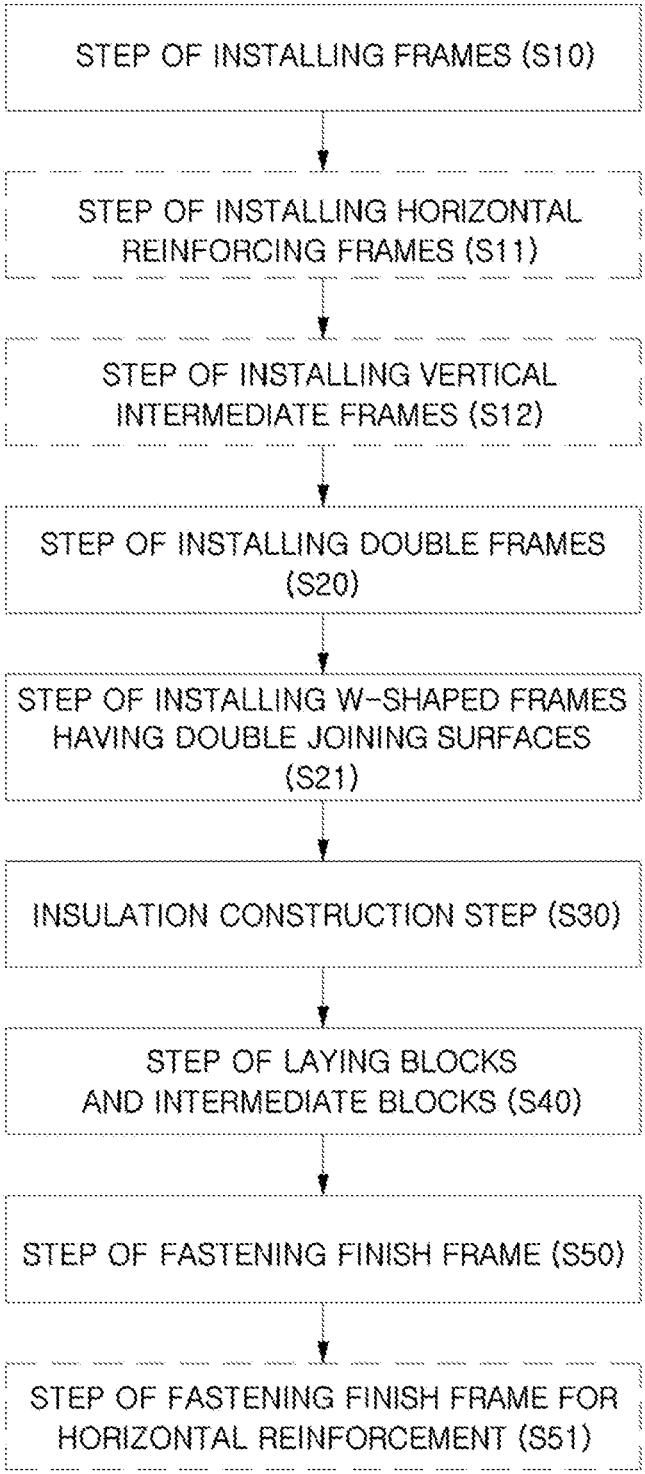

A method of constructing a wall using blocks and frames each having a wedge-shaped coupling part formed therein according to a sixteenth embodiment of the present invention is the same as the construction method according to the fifteenth embodiment. As illustrated in FIG. 22, the step of installing the double frames (S20) includes a step of installing W-shaped frames having double joining surfaces (S21), in which wedge-shaped concave grooves or wedge-shaped protrusions formed in the outer side or inner side frames are disposed side by side in two columns so as to form a W-shaped concave groove or a W-shaped protrusion. In the step of installing the W-shaped frames having the double joining surfaces (S21), by forming W-shaped frames having double joining surfaces, in which wedge-shaped concave grooves 101 of the upper frame 100 at the outer side or inner side are disposed side by side in two columns so as to form a W-shaped concave groove 102, wedge-shaped protrusions 201 of the lower frame 200 at the outer side or inner side are disposed in two columns so as to form a W-shaped protrusion 202, and wedge-shaped protrusions 301 of the vertical frame 300 at the outer side or inner side are disposed in two columns so as to form a W-shaped protrusion 302, it is possible to maintain firm coupling between the frames and the blocks 400 even when design of a building requires forming a thick wall surface.

Figure 23:
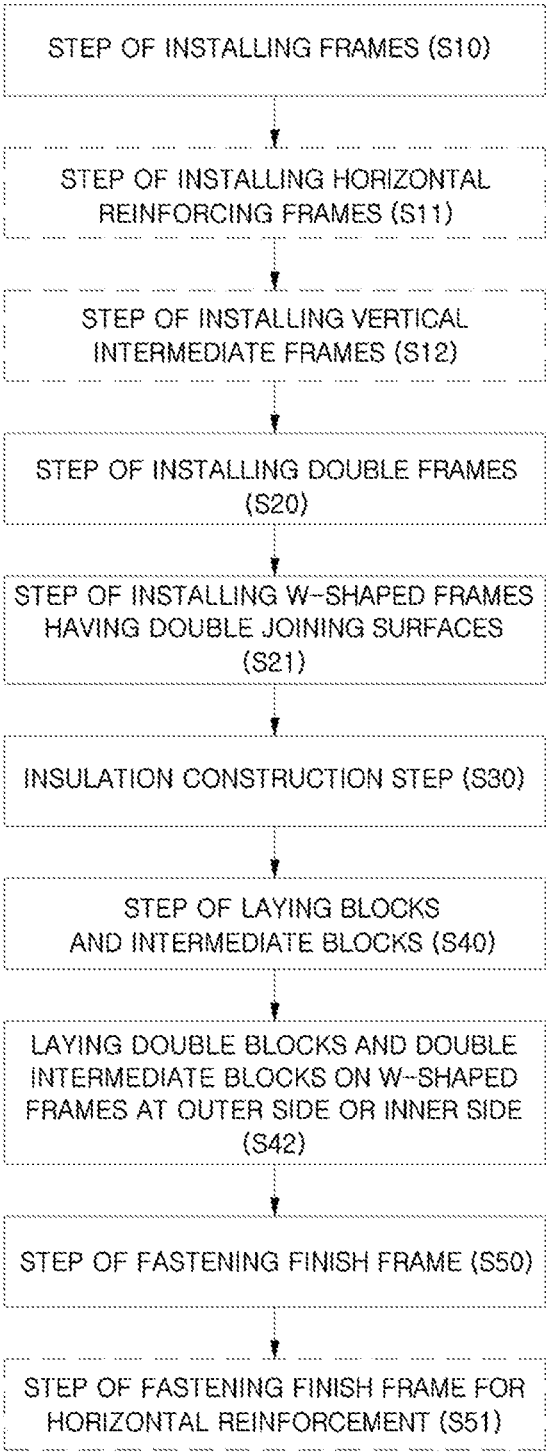

A method of constructing a wall using blocks and frames each having a wedge-shaped coupling part formed therein according to a seventeenth embodiment of the present invention is the same as the construction method according to the sixteenth embodiment. As illustrated in FIG. 23, the step of laying the blocks and the intermediate blocks (S40) includes a step of laying double blocks and double intermediate blocks on W-shaped frames at the outer side or inner side (S42), in which, on the W-shaped frames formed by the step of installing the W-shaped frames having the double joining surfaces (S21), double blocks 410 are laid and double intermediate blocks 510 are fitted and fixed between the double blocks 410, wherein the double block 410 is formed by connecting the two blocks 400 side by side so that the shapes of the wedge-shaped side protrusion 403 and the wedge-shaped concave groove 404 form a W-shape, and the double intermediate block 510 is formed by connecting the two intermediate blocks 500 side by side so that the shape of the wedge-shaped side concave groove 503 forms a W-shape. The double block 410 has isosceles triangular wedge-shaped upper protrusions 401 disposed in two columns throughout an upper surface so as to form a W-shaped upper protrusion 411, isosceles triangular wedge-shaped lower concave grooves 402 disposed in two columns throughout a lower surface so as to form a W-shaped lower concave groove 412, isosceles triangular wedge-shaped side protrusions 403 disposed in two columns throughout one side surface so as to form a W-shaped side protrusion 413, and isosceles triangular wedge-shaped side concave grooves 404 disposed in two columns throughout the other side surface so as to form a W-shaped side concave groove 414. The W-shaped protrusions and W-shaped concave grooves of the double blocks 410 are coupled to the double frames formed in the step of forming the W-shaped frames having the double joining surfaces (S21).

Also, in the step of laying the double blocks and the double intermediate blocks on the W-shaped frames at the outer side or inner side (S42), by the wedge-shaped upper protrusion 411 and the wedge-shaped lower concave groove 412 of adjacent double blocks 410 being fitted to each other, and the wedge-shaped side protrusion 413 and the wedge-shaped side concave groove 414 of adjacent double blocks 410 being fitted to each other, the double blocks 410 are laid in a zigzag manner so that longitudinal side corners of the double blocks 410 are positioned on a central portion of the upper surface or the lower surface of the double block 410 stacked vertically adjacent thereto.

Here, to allow the vertical frames 300 and the double blocks 410 to be completely coupled without a gap therebetween even when the double blocks 410 are disposed in a zigzag manner, double blocks 410, of which ever other one has a short length, are applied as the double blocks 410 coupled to the vertical frames 300.

Also, the double intermediate block 510 has isosceles triangular wedge-shaped upper protrusions 501 disposed in two columns throughout an upper surface so as to form a W-shaped upper protrusion 511, isosceles triangular wedge-shaped lower concave grooves 502 disposed in two columns throughout a lower surface so as to form a W-shaped lower concave groove 512, and isosceles triangular wedge-shaped side concave grooves 503 disposed in two columns throughout both side surfaces so as to form a W-shaped side concave groove 513. By fitting the double intermediate block 510 between the double blocks 410, the direction in which the double blocks 410 are laid is changed so that the W-shaped side concave groove 414 of the double block 410 may be coupled to the W-shaped protrusion 301 of the vertical frame 300.

Here, when the double blocks 410 and the double intermediate blocks 510 are laid on the W-shaped frames having the double joining surfaces in the step of laying the double blocks and the double intermediate blocks on the W-shaped frames at the outer side or inner side (S42), the number of blocks being laid is reduced such that the process time is shortened, and firmer coupling is possible between the blocks or between the blocks and frames as compared with when a single-type wedge-shaped protrusion and a single-type wedge-shaped concave groove are coupled. In this way, it is possible to more effectively prevent the detachment of the blocks due to vibration and impact.

Figure 24:
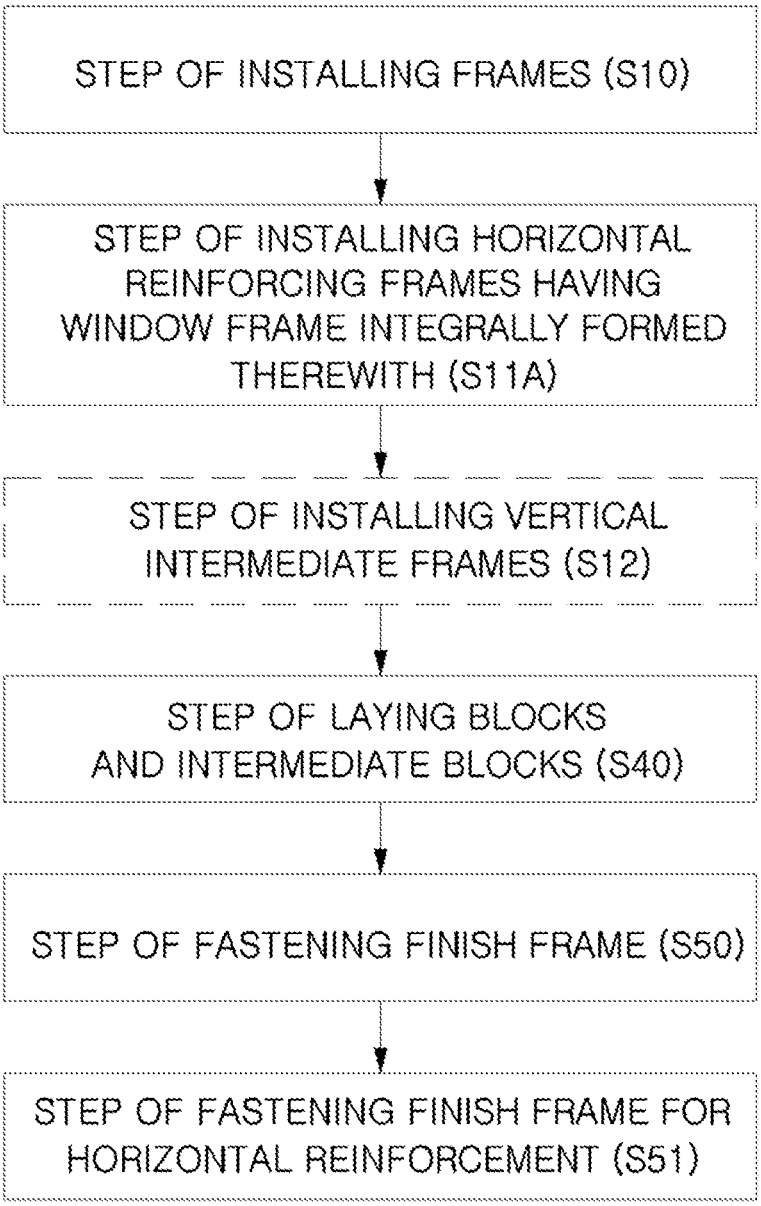

A method of constructing a wall using blocks and frames each having a wedge-shaped coupling part formed therein according to an eighteenth embodiment of the present invention is the same as the construction method according to the twelfth or thirteenth embodiment. As illustrated in FIG. 24, the step of installing the horizontal reinforcing frames (S11) includes a step of installing horizontal reinforcing frames having a window frame integrally formed therewith (511A) in which, when installing the horizontal reinforcing frames 600, the horizontal reinforcing frames 600 whose central portion is integrally formed with a window frame 900 are mounted so as to be parallel to the upper frame 100 and the lower frame 200. By the wedge-shaped side concave groove 404 of the block 400 being fitted and firmly fixed to the wedge-shaped protrusion 901 formed at a side surface of the window frame 900 integrally manufactured with the horizontal reinforcing frame 600, the window frame 900 is integrally formed with the upper frame 100, the lower frame 200, and the vertical frames 300. In this way it is possible to allow a window to have structural strength, eliminate the need for a separate window frame 900 construction process, thus preventing damage to a structural wall that may occur in the process of constructing the window frame 900, and reduce the cost and time for installing the window frame 900.

Figure 25:
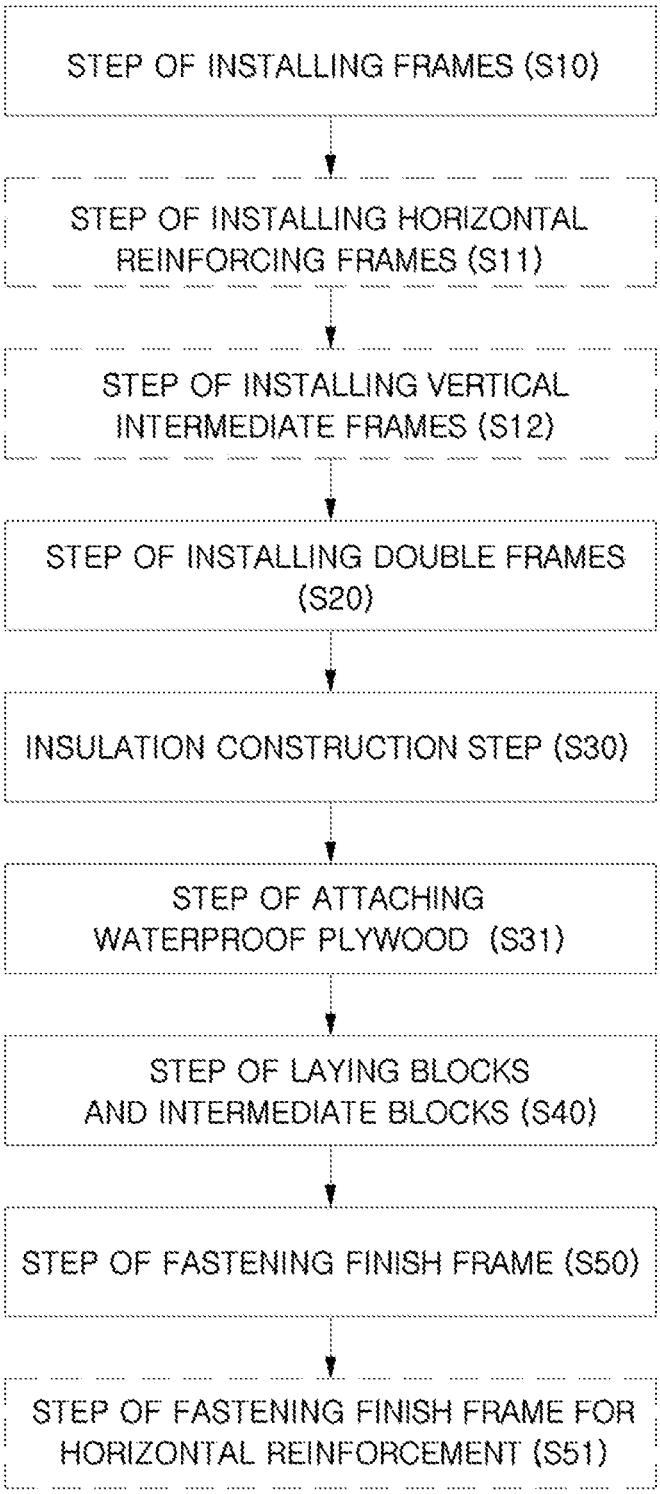

A method of constructing a wall using blocks and frames each having a wedge-shaped coupling part formed therein according to a nineteenth embodiment of the present invention is the same as the construction method according to the fifteenth embodiment. As illustrated in FIG. 25, the insulation construction step (S30) includes a step of attaching a waterproof plywood (S31), in which a waterproof plywood 810 with an adhesive layer formed thereon is attached to a surface of the insulator panel 800. In this way, it is possible to further improve water resistance of the wall.

Figure 26:
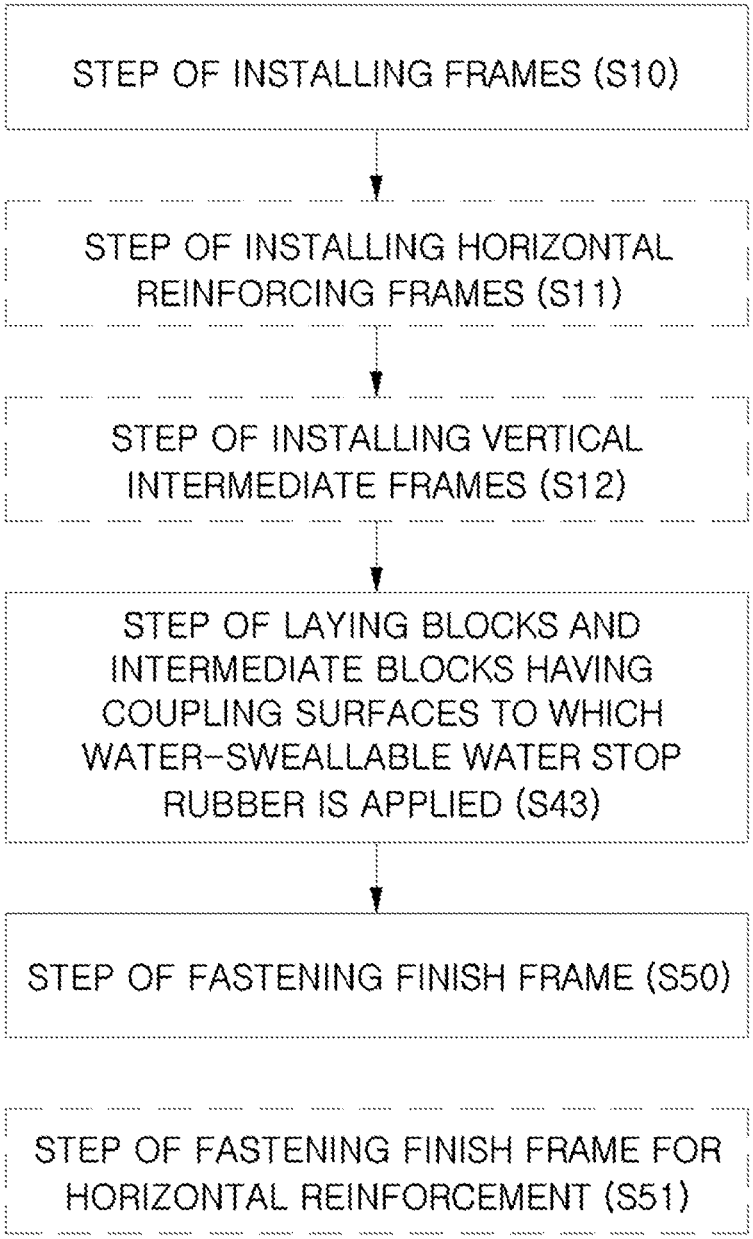

A method of constructing a wall using blocks and frames each having a wedge-shaped coupling part formed therein according to a twentieth embodiment of the present invention is the same as the construction method according to the eleventh to thirteenth embodiments. As illustrated in FIG. 26, the step of laying the blocks and the intermediate blocks (S40) of the eleventh to thirteenth embodiments may include a step of laying blocks and intermediate blocks which have coupling surfaces to which water-swellable water stop rubber is applied (S43), in which the blocks 400 and the intermediate blocks 500 which have binding surfaces finished with the water-swellable water stop rubber are laid. As described above, by swelling due to moisture, the water-swellable water stop rubber may improve sound insulation, windproofness, and waterproofness of a wall formed by the laid blocks. By applying the blocks 400 and the intermediate blocks 500 whose binding surfaces are finished with the water-swellable water stop rubber instead of applying the water-swellable water stop rubber in the middle of the wall construction, it is possible to complete the bricklaying process more promptly.

The exemplary embodiments of the present invention have been described above, but those of ordinary skill in the art to which the present invention pertains should understand that the present invention may be performed in other specific forms without changing the technical idea or essential features of the present invention.

Therefore, the embodiments described above should be understood as being illustrative in all aspects, instead of limiting. The scope of the present invention, which has been described in the detailed description above, is shown in the claims below. All changes or modifications derived from the meaning and scope of the claims and their equivalents should be interpreted as falling within the scope of the present invention.

The invention claimed is:

1. A wall structure comprising:

an upper frame (100) mounted on a surface of a beam, the upper frame (100) having an isosceles triangular wedge-shaped concave groove (101) formed throughout a lower surface of the upper frame, wherein a corner of the wedge-shaped concave groove (101) is parallel to a longitudinal direction of the beam;

a lower frame (200) mounted on a surface of a slab, the lower frame (200) having an isosceles triangular wedge-shaped protrusion (201) formed throughout an upper surface of the lower frame, wherein a corner of the wedge-shaped protrusion (201) is parallel to a longitudinal direction of the slab;

vertical frames (300) mounted on outer side or inner side surfaces of pillars so as to be connected to ends of the upper frame (100) and the lower frame (200), the vertical frames (300) each having an isosceles triangular wedge-shaped protrusion (301) formed throughout an inner side surface of each of the vertical frames, wherein a corner of the wedge-shaped protrusion (301) of each of the vertical frames is parallel to a height direction of one of the pillars;

blocks (400) disposed between the upper frame (100), the lower frame (200), and the vertical frames (300), the blocks (400) each having an isosceles triangular wedge-shaped upper protrusion (401) formed throughout an upper surface thereof, an isosceles triangular wedge-shaped lower concave groove (402) formed throughout a lower surface thereof, and an isosceles triangular wedge-shaped side protrusion (403) formed throughout one side surface thereof and an isosceles triangular wedge-shaped side concave groove (404) formed throughout another side surface thereof, wherein the wedge-shaped upper protrusion (401) and the wedge-shaped lower concave groove (402) are fitted to each other, and the wedge-shaped side protrusion (403) and the wedge-shaped side concave groove (404) are fitted to each other, and the blocks (400) disposed in a zigzag manner so that longitudinal side corners of the blocks (400) are positioned on a central portion of the upper surface or the lower surface of the blocks (400) stacked vertically adjacent thereto;

intermediate blocks (500) fitted between the blocks (400) to change a direction in which the blocks (400) are disposed, so that the wedge-shaped side concave grooves (404) of the blocks (400) are coupled to the wedge-shaped protrusions (301) of the vertical frames (300), the intermediate blocks (500) each having an isosceles triangular wedge-shaped upper protrusion (501) formed throughout an upper surface thereof, an isosceles triangular wedge-shaped lower concave groove (502) formed throughout a lower surface thereof, and an isosceles triangular wedge-shaped side concave groove (503) formed throughout each of two side surfaces thereof; and a finish frame (700) formed of two frame bodies (701), which have a rhombic cross-section and are symmetrical to each other, and a frame body fastener (702) configured to pass through and fix the two frame bodies (701), wherein the two frame bodies (701) are fitted between the blocks (400) disposed on an uppermost end portion and the upper frame (100) in directions toward an outer side and an inner side of a wall surface formed by the blocks (400), upper surfaces of the two coupled frame bodies (701) are disposed to come in contact with the wedge-shaped concave groove (101) of the upper frame (100), and lower surfaces of the frame bodies (701) are disposed to come in contact with the wedge-shaped upper protrusions (401) of the blocks (400) disposed on the uppermost end portion.

2. The wall structure of claim 1, wherein one or more horizontal reinforcing frames (600) are mounted between the upper frame (100) and the lower frame (200) so as to be parallel to the upper frame (100) and the lower frame (200), the one or more horizontal reinforcing frames (600) each having an isosceles triangular wedge-shaped protrusion (601) formed throughout an upper surface thereof and an isosceles triangular wedge-shaped concave groove (602) formed throughout a lower surface thereof, wherein corners of the wedge-shaped protrusion (601) and the wedge-shaped concave groove (602) are parallel to a longitudinal direction of the upper frame (100) and the lower frame (200), and the finish frame (700) is fitted and fixed between the wedge-shaped upper protrusions (401) of the blocks (400) and the wedge-shaped concave grooves (602) of the horizontal reinforcing frames (600).

3. The wall structure of claim 2, wherein one or more vertical intermediate frames (310) are installed between the vertical frames, an upper end and a lower end of the respective vertical intermediate frame (310) are connected and coupled to a surface of the beam and a surface of the slab, respectively, side ends of the respective horizontal reinforcing frame (600) are fixed to side surfaces of the respective vertical frame (300) and the respective vertical intermediate frame (310) by a fastening material, an isosceles triangular wedge-shaped protrusion (311) is formed throughout side surfaces of the respective vertical intermediate frame (310), a corner of the wedge-shaped protrusion (311) is parallel to a height direction of a pillar, and the wedge-shaped protrusion (311) of the respective vertical intermediate frame (310) is disposed to come in contact with the wedge-shaped side concave groove (404) of the block (400).

4. The wall structure of claim 2, wherein a window frame (900) is integrally formed at a central portion of the horizontal reinforcing frame (600), the window frame (900) having isosceles triangular wedge-shaped protrusions (901) formed throughout side surfaces thereof.

5. The wall structure of claim 1, wherein the isosceles triangular wedge-shaped protrusions and the isosceles triangular wedge-shaped concave grooves of the frames, the blocks (400), and the intermediate blocks (500) are configured to form an obtuse angle.

6. The wall structure of claim 1, wherein binding surfaces of the blocks (400) and the intermediate blocks (500) include rubber.

7. The wall structure of claim 1, wherein the upper frame (100), the lower frame (200), and the vertical frames (300) are each formed of a double structure and an insulator panel (800) is configured to be fitted in a space between the blocks (400) which are fitted to each of the upper frames (100), the lower frames (200), and the vertical frames (300).

8. The wall structure of claim 7, wherein outer side or inner side frames are formed of a double structure in which wedge-shaped concave grooves (101) of the upper frame (100) are disposed side by side in two columns so as to form a W-shaped concave groove (102), wedge-shaped protrusions (201) of the lower frame (200) are disposed in two columns so as to form a W-shaped protrusion (202), and wedge-shaped protrusions (301) of the vertical frame (300) are disposed in two columns so as to form a W-shaped protrusion (302).

9. The wall structure of claim 8, wherein double blocks (410), each having isosceles triangular wedge-shaped upper protrusions (401) disposed in two columns throughout an upper surface thereof so as to form a W-shaped upper protrusion (411), isosceles triangular wedge-shaped lower concave grooves (402) disposed in two columns throughout a lower surface thereof so as to form a W-shaped lower concave groove (412), isosceles triangular wedge-shaped side protrusions (403) disposed in two columns throughout one side surface thereof so as to form a W-shaped side protrusion (413), and isosceles triangular wedge-shaped side concave grooves (404) disposed in two columns throughout the other side surface thereof so as to form a W-shaped side concave groove (414), are, by the wedge-shaped upper protrusion (411) and the wedge-shaped lower concave groove (412) being fitted to each other, and the wedge-shaped side protrusion (413) and the wedge-shaped side concave groove (414) being fitted to each other, disposed in a zigzag manner on the outer side or inner side frames formed of the double structure so that longitudinal side corners of the double blocks (410) are positioned on a central portion of the upper surface or the lower surface of the double blocks (410) stacked vertically adjacent thereto, and double intermediate blocks (510) are fitted between the double blocks (410) to change a direction in which the double blocks (410) are disposed, so that the W-shaped side concave groove (414) of the double blocks (410) is coupled to the W-shaped protrusion (302) of the vertical frame (300), the double intermediate blocks (510) each having isosceles triangular wedge-shaped upper protrusions (501) disposed in two columns throughout an upper surface thereof so as to form a W-shaped upper protrusion (511), isosceles triangular wedge-shaped lower concave grooves (502) disposed in two columns throughout a lower surface thereof so as to form a W-shaped lower concave groove (512), and isosceles triangular wedge-shaped side concave grooves (503) disposed in two columns throughout side surfaces thereof so as to form a W-shaped side concave groove (513).

10. The wall structure of claim 7, wherein a waterproof plywood (810) with an adhesive layer formed thereon is attached to a surface of the insulator panel (800).

11. A method of constructing a wall using blocks and frames each having a wedge-shaped coupling part formed therein, the method comprising:

a step of installing frames (S10), in which an upper frame (100) is mounted on a surface of the beam, the upper frame (100) having an isosceles triangular wedge-shaped concave groove (101) formed throughout a lower surface thereof, wherein a corner of the wedge-shaped concave groove (101) is parallel to a longitudinal direction of a beam, a lower frame (200) is mounted on a surface of the slab, the lower frame (200) having an isosceles triangular wedge-shaped protrusion (201) formed throughout an upper surface thereof, wherein a corner of the wedge-shaped protrusion (201) is parallel to a longitudinal direction of a slab, and vertical frames (300) are mounted on outer side surfaces or inner side surfaces of pillars so as to be connected to ends of the upper frame (100) and the lower frame (200), the vertical frames (300) each having an isosceles triangular wedge-shaped protrusion (301) formed throughout an inner side surface thereof, wherein a corner of the wedge-shaped protrusion (301) is parallel to a height direction of one of the pillars;

a step of laying blocks and intermediate blocks (S40), in which, when blocks (400) are laid by being fitted between the upper frame (100), the lower frame (200), and the vertical frames (300), the blocks (400) each having an isosceles triangular wedge-shaped upper protrusion (401) formed throughout an upper surface thereof, an isosceles triangular wedge-shaped lower concave groove (402) formed throughout a lower surface thereof, and an isosceles triangular wedge-shaped side protrusion (403) formed throughout one side surface thereof and an isosceles triangular wedge-shaped side concave groove (404) formed throughout another side surface thereof, wherein, by the wedge-shaped upper protrusion (401) and the wedge-shaped lower concave groove (402) being fitted to each other, and the wedge-shaped side protrusion (403) and the wedge-shaped side concave groove (404) being fitted to each other, the blocks (400) are laid in a zigzag manner so that longitudinal side corners of the blocks (400) are positioned on a central portion of the upper surface or the lower surface of the blocks (400) stacked vertically adjacent thereto, intermediate blocks (500) are fitted between the blocks (400) to change a direction in which the blocks (400) are laid, so that the wedge-shaped side concave groove (404) of the blocks (400) is coupled to the wedge-shaped protrusion (301) of the vertical frames (300) at both sides, the intermediate blocks (500) each having an isosceles triangular wedge-shaped upper protrusion (501) formed throughout an upper surface thereof, an isosceles triangular wedge-shaped lower concave groove (502) formed throughout a lower surface thereof, and an isosceles triangular wedge-shaped side concave groove (503) formed throughout side surfaces thereof; and a step of fastening a finish frame (S50), in which upper surfaces of frame bodies (701) of the finish frame (700) are engaged to come in contact with the wedge-shaped concave groove (101) of the upper frame (100), lower surfaces of the frame bodies (701) are engaged to come in contact with the wedge-shaped upper protrusions (401) of the blocks (400) laid on the uppermost end portion, and then the frame bodies (701) are fixed using a frame body fastener (702), wherein the finish frame (700) includes two frame bodies (701) which have a rhombic cross-section and are symmetrical to each other.

12. The method of claim 11, wherein the step of installing the frames (S10) includes a step of installing horizontal reinforcing frames (S11), in which one or more horizontal reinforcing frames (600) are mounted between the upper frame (100) and the lower frame (200) so as to be parallel to the upper frame (100) and the lower frame (200), the one or more horizontal reinforcing frames (600) each having an isosceles triangular wedge-shaped protrusion (601) formed throughout an upper surface thereof and an isosceles triangular wedge-shaped concave groove (602) formed throughout a lower surface thereof, and the step of fastening the finish frame (S50) includes a step of fastening the finish frame for horizontal reinforcement (S51), in which the finish frame (700) is fitted and fixed between the wedge-shaped upper protrusions (401) of the blocks (400), which are laid on each layer formed by the horizontal reinforcing frames (600) in the step of laying the blocks and the intermediate blocks (S40), and the wedge-shaped concave grooves (602) of the horizontal reinforcing frames (600).

13. The method of claim 12, further comprising, after the step of installing the horizontal reinforcing frames (S11), a step of installing vertical intermediate frames (S12), in which one or more vertical intermediate frames (310), each having an isosceles triangular wedge-shaped protrusion (311) formed throughout side surfaces thereof, are installed between the vertical frames (300), an upper end and a lower end of the one or more vertical intermediate frames (310) are connected and coupled to a surface of the beam and a surface of the slab, respectively, and side ends of the horizontal reinforcing frame (600) are fixed to side surfaces of the respective vertical frame (300) and the respective vertical intermediate frame (310) by a fastening material so as to divide a wall surface into sections, of which adjacent sections are coupled by the same respective vertical intermediate frame (310).

14. The method of claim 12, wherein the step of installing the horizontal reinforcing frames (S11) includes a step of installing horizontal reinforcing frames having a window frame integrally formed therewith (S11A), in which the horizontal reinforcing frames (600) whose central portion is integrally formed with the window frame (900) are mounted so as to be parallel to the upper frame (100) and the lower frame (200).

15. The method of claim 11, wherein the step of laying the blocks and the intermediate blocks (S40) includes a step of applying an adhesive (S41), in which the blocks (400) and the intermediate blocks (500) are laid after an adhesive is applied on each interface of the blocks (400) and the intermediate blocks (500).

16. The method of claim 11, wherein the step of installing the frames (S10) includes a step of installing double frames (S20), and the method further comprises, between the step of installing the double frames (S20) and the step of laying the blocks and the intermediate blocks (S40), an insulation construction step (S30) in which an insulator panel (800) is attached to the double frames.

17. The method of claim 16, wherein the step of installing the double frames (S20) includes a step of installing W-shaped frames having double joining surfaces (S21), in which wedge-shaped concave grooves (101) of the upper frame (100) are disposed side by side in two columns so as to form a W-shaped concave groove (102), wedge-shaped protrusions (201) of the lower frame (200) are disposed in two columns so as to form a W-shaped protrusion (202), and wedge-shaped protrusions (301) of each of the vertical frames (300) are disposed in two columns so as to form a W-shaped protrusion (302).

18. The method of claim 17, wherein the step of laying the blocks and the intermediate blocks (S40) includes a step of laying double blocks and double intermediate blocks on W-shaped frames (S42), in which, on the double frames formed by the step of forming the W-shaped frames having the double joining surfaces (S21), double blocks (410), each having isosceles triangular wedge-shaped upper protrusions (401) disposed in two columns throughout an upper surface thereof so as to form a W-shaped upper protrusion (411), isosceles triangular wedge-shaped lower concave grooves (402) disposed in two columns throughout a lower surface thereof so as to form a W-shaped lower concave groove (412), isosceles triangular wedge-shaped side protrusions (403) disposed in two columns throughout one side surface thereof so as to form a W-shaped side protrusion (413), and isosceles triangular wedge-shaped side concave grooves (404) disposed in two columns throughout the other side surface thereof so as to form a W-shaped side concave groove (414), are, by the wedge-shaped upper protrusion (411) and the wedge-shaped lower concave groove (412) being fitted to each other, and the wedge-shaped side protrusion (413) and the wedge-shaped side concave groove (414) being fitted to each other, laid in a zigzag manner so that longitudinal side corners of the double blocks (410) are positioned on a central portion of the upper surface or the lower surface of the double blocks (410) stacked vertically adjacent thereto, and double intermediate blocks (510) are fitted between the double blocks (410) to change a direction in which the double blocks (410) are laid, so that the W-shaped side concave groove (414) of the laid double blocks (410) is coupled to the W-shaped protrusion (302) of the vertical frame (300), the double intermediate blocks (510) each having isosceles triangular wedge-shaped upper protrusions (501) disposed in two columns throughout an upper surface thereof so as to form a W-shaped upper protrusion (511), isosceles triangular wedge-shaped lower concave grooves (502) disposed in two columns throughout a lower surface thereof so as to form a W-shaped lower concave groove (512), and isosceles triangular wedge-shaped side concave grooves (503) disposed in two columns throughout side surfaces thereof so as to form a W-shaped side concave groove (513).

19. The method of claim 16, wherein the insulation construction step (S30) includes a step of attaching a waterproof plywood (S31), in which the waterproof plywood (810) with an adhesive layer formed thereon is attached to a surface of the insulator panel (800).

20. The method of claim 11, wherein the step of laying the blocks and the intermediate blocks (S40) includes a step of laying blocks and intermediate blocks which have binding surfaces to which rubber is applied (S43), in which the blocks (400) and the intermediate blocks (500) which have binding surfaces finished with the rubber are laid.

* * * * *